US009352600B2

(12) United States Patent
Yamaguchi et al.

(10) Patent No.: US 9,352,600 B2
(45) Date of Patent: May 31, 2016

(54) TAPE CASSETTE

(71) Applicant: Brother Kogyo Kabushiki Kaisha, Nagoya-shi, Aichi-ken (JP)

(72) Inventors: Koshiro Yamaguchi, Kakamigahara (JP); Akira Sago, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/141,576

(22) Filed: Dec. 27, 2013

(65) Prior Publication Data

US 2014/0105663 A1 Apr. 17, 2014

Related U.S. Application Data

(63) Continuation of application No. 13/430,080, filed on Mar. 26, 2012, which is a continuation-in-part of application No. PCT/JP2009/070971, filed on Dec. 16, 2009.

(51) Int. Cl.

| | |
|---|---|
| ***B41J 35/28*** | (2006.01) |
| ***B41J 33/00*** | (2006.01) |
| ***B41J 3/407*** | (2006.01) |

(Continued)

(52) U.S. Cl.

CPC ..... *B41J 33/003* (2013.01); *B41J 3/4075* (2013.01); *B41J 15/044* (2013.01); *B41J 32/00* (2013.01); *B41J 35/28* (2013.01)

(58) Field of Classification Search

CPC ..... B41J 33/003; B41J 3/4075; B41J 15/044; B41J 32/00; B41J 35/28

USPC ..... 400/207, 208, 611, 613, 619, 242, 244

See application file for complete search history.

(56) References Cited

U.S. PATENT DOCUMENTS

| | | | |
|---|---|---|---|
| 4,226,547 | A | 10/1980 | Bradshaw et al. |
| 4,360,278 | A | 11/1982 | Paque |
| D267,330 | S | 12/1982 | Worrell |

(Continued)

FOREIGN PATENT DOCUMENTS

| | | | |
|---|---|---|---|
| CN | 1148547 | A | 4/1997 |
| CN | 1166155 | A | 11/1997 |

(Continued)

OTHER PUBLICATIONS

Sep. 22, 2013 (CN) Office Action issued in Chinese Patent Application No. 201010150109.5.

(Continued)

*Primary Examiner* — Matthew G Marini
(74) *Attorney, Agent, or Firm* — Banner & Witcoff, Ltd.

(57) ABSTRACT

A tape cassette includes a cassette case, a tape roll housed in the cassette case, an arm portion that guides a tape, and a long hole extending in a left-right direction of the cassette case and formed straddling a center position of the cassette case in the left-right direction, wherein a first distance (a length of the long hole in the left-right direction) is larger than a second distance (a length from an end portion of the tape cassette in an opposite direction to a feed direction of the tape fed in the arm portion, to an end portion of the long hole in the opposite direction), and a center of gravity of the tape cassette is located in a specific area whose both end positions in the left-right direction are the same as those of the long hole, and which extends in a front-rear direction.

42 Claims, 28 Drawing Sheets

(51) Int. Cl.

| | |
|---|---|
| ***B41J 15/04*** | (2006.01) |
| ***B41J 32/00*** | (2006.01) |

(56) References Cited

U.S. PATENT DOCUMENTS

| | | | |
|---|---|---|---|
| 4,391,539 | A | 7/1983 | Connoy |
| 4,402,619 | A | 9/1983 | Paque et al. |
| 4,557,617 | A | 12/1985 | Richardson et al. |
| 4,567,488 | A | 1/1986 | Moriguchi et al. |
| 4,678,353 | A | 7/1987 | Richardson et al. |
| 4,773,775 | A | 9/1988 | Bradshaw et al. |
| 4,815,871 | A | 3/1989 | McGourty et al. |
| 4,815,874 | A | 3/1989 | Richardson et al. |
| 4,832,514 | A | 5/1989 | Basile |
| 4,844,636 | A | 7/1989 | Paque |
| D307,296 | S | 4/1990 | Ivarson et al. |
| 4,915,516 | A | 4/1990 | Shimizu et al. |
| 4,917,514 | A | 4/1990 | Richardson et al. |
| D307,918 | S | 5/1990 | Goda |
| 4,927,278 | A | 5/1990 | Kuzuya et al. |
| 4,930,913 | A | 6/1990 | Basile |
| D311,416 | S | 10/1990 | Richardson et al. |
| 4,983,058 | A | 1/1991 | Nagae |
| 5,022,771 | A | 6/1991 | Paque |
| D319,070 | S | 8/1991 | Lavander |
| D320,391 | S | 10/1991 | Paque |
| 5,056,940 | A | 10/1991 | Basile |
| 5,104,247 | A | 4/1992 | Ohshima |
| 5,111,216 | A | 5/1992 | Richardson et al. |
| 5,188,469 | A | 2/1993 | Nagao et al. |
| 5,195,835 | A | 3/1993 | Collins |
| 5,203,951 | A | 4/1993 | Hattori et al. |
| 5,223,939 | A | 6/1993 | Imaizumi et al. |
| 5,239,437 | A | 8/1993 | Hoge et al. |
| D342,275 | S | 12/1993 | Cooper |
| RE34,521 | E | 1/1994 | Shimizu et al. |
| 5,277,503 | A | 1/1994 | Nagao |
| 5,318,370 | A | 6/1994 | Nehowig |
| 5,348,406 | A | 9/1994 | Yoshiaki et al. |
| 5,350,243 | A | 9/1994 | Ichinomiya et al. |
| D352,305 | S | 11/1994 | Cooper |
| D356,333 | S | 3/1995 | Pearce et al. |
| 5,399,033 | A | 3/1995 | Putman |
| D357,497 | S | 4/1995 | Gray et al. |
| 5,411,339 | A | 5/1995 | Bahrabadi et al. |
| 5,419,648 | A | 5/1995 | Nagao et al. |
| D359,303 | S | 6/1995 | Gray et al. |
| 5,424,757 | A | 6/1995 | Thom |
| 5,429,443 | A | 7/1995 | Kobayashi et al. |
| 5,431,504 | A | 7/1995 | Beadman et al. |
| 5,435,657 | A | 7/1995 | Pearce et al. |
| 5,466,076 | A | 11/1995 | Kobayashi et al. |
| 5,492,420 | A | 2/1996 | Nunokawa et al. |
| 5,494,362 | A | 2/1996 | Kobayashi et al. |
| 5,506,736 | A | 4/1996 | Ota |
| 5,511,891 | A | 4/1996 | Nehowig et al. |
| 5,533,818 | A | 7/1996 | Bahrabadi |
| 5,538,352 | A | 7/1996 | Sugiura |
| 5,540,510 | A | 7/1996 | Sims et al. |
| 5,541,796 | A | 7/1996 | Sawada |
| 5,553,952 | A | 9/1996 | Umbach |
| 5,564,843 | A | 10/1996 | Kawaguchi |
| 5,593,237 | A | 1/1997 | Nozaki et al. |
| 5,599,119 | A | 2/1997 | Nunokawa et al. |
| 5,605,404 | A | 2/1997 | Nunokawa et al. |
| 5,620,268 | A | 4/1997 | Yamaguchi et al. |
| 5,634,728 | A | 6/1997 | Nunokawa et al. |
| 5,653,542 | A | 8/1997 | Sugimoto et al. |
| 5,658,083 | A | 8/1997 | Day et al. |
| 5,709,486 | A | 1/1998 | Day |
| 5,727,888 | A | 3/1998 | Sugimoto et al. |
| 5,730,536 | A | 3/1998 | Yamaguchi |
| 5,752,777 | A | 5/1998 | Nunokawa et al. |
| 5,765,954 | A | 6/1998 | Nunokawa et al. |
| 5,771,803 | A | 6/1998 | Takami |
| 5,795,086 | A | 8/1998 | Watanabe et al. |
| 5,813,773 | A | 9/1998 | Kawai |
| 5,823,689 | A | 10/1998 | Nehowig et al. |
| 5,825,724 | A | 10/1998 | Matsumoto et al. |
| 5,826,995 | A | 10/1998 | Day et al. |
| 5,857,788 | A | 1/1999 | Gutsell et al. |
| 5,860,752 | A | 1/1999 | Watanabe et al. |
| 5,887,993 | A | 3/1999 | Nunokawa et al. |
| 5,961,225 | A | 10/1999 | Nunokawa et al. |
| 5,964,539 | A | 10/1999 | Yamaguchi et al. |
| 5,967,678 | A | 10/1999 | Nunokawa et al. |
| 5,997,194 | A | 12/1999 | Nunokawa et al. |
| 6,012,860 | A | 1/2000 | Nunokawa et al. |
| 6,042,280 | A | 3/2000 | Yamaguchi et al. |
| 6,050,672 | A | 4/2000 | Matsuhashi |
| 6,050,734 | A | 4/2000 | Watanabe et al. |
| 6,106,171 | A | 8/2000 | Nunokawa et al. |
| 6,116,796 | A | 9/2000 | Yamaguchi et al. |
| 6,132,120 | A | 10/2000 | Yamaguchi et al. |
| 6,146,034 | A | 11/2000 | Watanabe et al. |
| 6,149,325 | A | 11/2000 | Nunokawa et al. |
| 6,160,679 | A | 12/2000 | Maekawa et al. |
| 6,168,328 | B1 | 1/2001 | Ueda et al. |
| 6,190,065 | B1 | 2/2001 | Brzuskiewicz |
| 6,190,069 | B1 | 2/2001 | Yamaguchi et al. |
| 6,196,740 | B1 | 3/2001 | Yamaguchi et al. |
| 6,270,269 | B1 | 8/2001 | Watanabe et al. |
| 6,317,156 | B1 | 11/2001 | Nagasaki et al. |
| 6,334,724 | B2 | 1/2002 | Yamaguchi et al. |
| 6,406,202 | B1 * | 6/2002 | Unno et al. ..... 400/613 |
| 6,435,744 | B1 | 8/2002 | Dunn et al. |
| 6,485,206 | B1 * | 11/2002 | Takahashi ..... 400/207 |
| 6,520,696 | B2 | 2/2003 | Huss et al. |
| 6,644,876 | B2 | 11/2003 | Carriere et al. |
| D486,853 | S | 2/2004 | Wilken et al. |
| 6,709,179 | B2 | 3/2004 | Yamaguchi et al. |
| 6,929,415 | B2 | 8/2005 | Wilken |
| D519,522 | S | 4/2006 | Lee |
| 7,070,347 | B2 | 7/2006 | Carriere et al. |
| 7,097,372 | B1 | 8/2006 | Heyse et al. |
| 7,121,751 | B2 | 10/2006 | Harada et al. |
| 7,128,483 | B2 | 10/2006 | Harada et al. |
| D534,203 | S | 12/2006 | Harada et al. |
| D542,334 | S | 5/2007 | Harada et al. |
| 7,287,715 | B2 | 10/2007 | Ban |
| D579,942 | S | 11/2008 | Terry et al. |
| 8,045,288 | B2 | 10/2011 | Ota et al. |
| 8,109,684 | B2 | 2/2012 | Yamaguchi |
| 8,382,389 | B2 | 2/2013 | Yamaguchi et al. |
| D681,727 | S | 5/2013 | Van Den Broecke |
| 8,529,142 | B2 | 9/2013 | Tanaka |
| 8,540,444 | B2 | 9/2013 | Vandermeulen et al. |
| 8,562,228 | B2 | 10/2013 | Yamaguchi et al. |
| 8,641,304 | B2 | 2/2014 | Yamaguchi et al. |
| 8,734,035 | B2 | 5/2014 | Suva et al. |
| 8,740,482 | B2 | 6/2014 | Yamaguchi et al. |
| 8,757,907 | B2 | 6/2014 | Yamaguchi et al. |
| 8,764,326 | B2 | 7/2014 | Yamaguchi et al. |
| 8,770,877 | B2 | 7/2014 | Yamaguchi et al. |
| 2002/0006303 | A1 | 1/2002 | Yamaguchi et al. |
| 2002/0012558 | A1 | 1/2002 | Huss et al. |
| 2002/0047063 | A1 | 4/2002 | Kaneda et al. |
| 2002/0135938 | A1 | 9/2002 | Hiraguchi et al. |
| 2003/0081978 | A1 | 5/2003 | Carriere et al. |
| 2004/0062586 | A1 | 4/2004 | Harada et al. |
| 2004/0233269 | A1 | 11/2004 | Tsubota |
| 2004/0265027 | A1 | 12/2004 | Hine et al. |
| 2005/0036816 | A1 | 2/2005 | Carriere et al. |
| 2005/0152732 | A1 | 7/2005 | Bandholz et al. |
| 2006/0088802 | A1 | 4/2006 | Akaiwa |
| 2006/0182921 | A1 | 8/2006 | Hioki et al. |
| 2006/0204304 | A1 | 9/2006 | Hioki et al. |
| 2006/0216100 | A1 | 9/2006 | Minoya et al. |
| 2006/0233582 | A1 | 10/2006 | Horiuchi |
| 2007/0009302 | A1 | 1/2007 | Vandermeulen |
| 2007/0009306 | A1 | 1/2007 | Harada et al. |
| 2007/0031171 | A1 | 2/2007 | Heyse et al. |
| 2007/0041772 | A1 | 2/2007 | Harada et al. |
| 2007/0070168 | A1 | 3/2007 | Mindler et al. |

(56) References Cited

U.S. PATENT DOCUMENTS

| | | | |
|---|---|---|---|
| 2007/0098473 | A1 | 5/2007 | Heyse et al. |
| 2007/0172293 | A1 | 7/2007 | Vandermeulen |
| 2007/0212149 | A1 | 9/2007 | Ota et al. |
| 2007/0231041 | A1 | 10/2007 | Ueda et al. |
| 2007/0237562 | A1 | 10/2007 | Kato et al. |
| 2007/0264070 | A1 | 11/2007 | Loo et al. |
| 2008/0050160 | A1 | 2/2008 | Yamaguchi et al. |
| 2008/0080922 | A1 | 4/2008 | Vandermeulen |
| 2008/0181708 | A1 | 7/2008 | Yamaguchi et al. |
| 2008/0310904 | A1 | 12/2008 | Yamaguchi et al. |
| 2009/0016795 | A1 | 1/2009 | Caveney et al. |
| 2009/0202283 | A1 | 8/2009 | Kumazaki et al. |
| 2009/0285617 | A1 | 11/2009 | Vandermeulen |
| 2010/0119281 | A1 | 5/2010 | Ford et al. |
| 2010/0166475 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0232862 | A1 | 9/2010 | Vandermeulen |
| 2010/0247208 | A1 | 9/2010 | Yamaguchi et al. |
| 2010/0272492 | A1 | 10/2010 | Van Britsom et al. |
| 2011/0058884 | A1 | 3/2011 | Kato et al. |
| 2012/0027485 | A1 | 2/2012 | Suva et al. |
| 2012/0027486 | A1 | 2/2012 | Suva et al. |
| 2012/0027487 | A1 | 2/2012 | Suva et al. |
| 2012/0057917 | A1 | 3/2012 | Van Britsom et al. |
| 2012/0170959 | A1 | 7/2012 | Vandermeulen et al. |
| 2014/0205350 | A1 | 7/2014 | Yamaguchi et al. |
| 2014/0218458 | A1 | 8/2014 | Suva et al. |

FOREIGN PATENT DOCUMENTS

| | | | |
|---|---|---|---|
| CN | 1085151 | C | 5/2002 |
| CN | 1415482 | A | 5/2003 |
| CN | 1663807 | A | 9/2005 |
| CN | 1762720 | | 4/2006 |
| CN | 1799851 | A | 7/2006 |
| CN | 1820940 | A | 8/2006 |
| CN | 1914045 | A | 2/2007 |
| CN | 1990261 | A | 7/2007 |
| CN | 1331684 | C | 8/2007 |
| CN | 101028771 | A | 9/2007 |
| CN | 101039807 | A | 9/2007 |
| CN | 101264701 | A | 9/2008 |
| CN | 101264702 | A | 9/2008 |
| CN | 101758676 | A | 6/2010 |
| EP | 119179 | A1 | 9/1984 |
| EP | 0329369 | A2 | 8/1989 |
| EP | 0511602 | A1 | 11/1992 |
| EP | 0555954 | A2 | 8/1993 |
| EP | 0629509 | A2 | 12/1994 |
| EP | 0684143 | A2 | 11/1995 |
| EP | 734878 | A2 | 10/1996 |
| EP | 0863021 | B1 | 9/1998 |
| EP | 0644506 | | 4/1999 |
| EP | 0644506 | B1 | 4/1999 |
| EP | 1284196 | A2 | 2/2003 |
| EP | 1516739 | A1 | 3/2005 |
| EP | 1700705 | A1 | 9/2006 |
| EP | 1707395 | A1 | 10/2006 |
| EP | 2236303 | A1 | 10/2010 |
| EP | 2236304 | A1 | 10/2010 |
| JP | S58-139415 | U | 9/1983 |
| JP | S60-99692 | U | 7/1985 |
| JP | H01-195088 | A | 8/1989 |
| JP | H02-56665 | | 4/1990 |
| JP | H02-56666 | U | 4/1990 |
| JP | 3-093584 | A | 4/1991 |
| JP | 3063155 | | 9/1991 |
| JP | H03-118672 | U | 12/1991 |
| JP | H03-120680 | U | 12/1991 |
| JP | H04-37575 | A | 2/1992 |
| JP | H04-133756 | A | 5/1992 |
| JP | H05-16342 | U | 3/1993 |
| JP | H05-63067 | A | 3/1993 |
| JP | H05-155067 | A | 6/1993 |
| JP | H05-54225 | U | 7/1993 |
| JP | H05-78565 | U | 10/1993 |
| JP | H05-294051 | A | 11/1993 |
| JP | H06-12053 | U | 2/1994 |
| JP | H06-124406 | A | 5/1994 |
| JP | 6-191081 | A | 7/1994 |
| JP | H06183117 | A | 7/1994 |
| JP | 6-210889 | A | 8/1994 |
| JP | H06-74348 | U | 10/1994 |
| JP | H06-328800 | A | 11/1994 |
| JP | H07-1805 | A | 1/1995 |
| JP | H07-9743 | A | 1/1995 |
| JP | H07-25123 | A | 1/1995 |
| JP | H07-47737 | A | 2/1995 |
| JP | 7020725 | | 3/1995 |
| JP | H07-61009 | A | 3/1995 |
| JP | H07-69497 | A | 3/1995 |
| JP | 7-108702 | A | 4/1995 |
| JP | H07-89115 | A | 4/1995 |
| JP | H07-89196 | A | 4/1995 |
| JP | H07-101133 | A | 4/1995 |
| JP | H07-137327 | A | 5/1995 |
| JP | H07-40456 | U | 7/1995 |
| JP | H07-251539 | A | 10/1995 |
| JP | H07-276695 | A | 10/1995 |
| JP | H07-290803 | A | 11/1995 |
| JP | H07-314864 | A | 12/1995 |
| JP | H07-314865 | A | 12/1995 |
| JP | H07-314866 | A | 12/1995 |
| JP | H08-25768 | A | 1/1996 |
| JP | H08-39909 | A | 2/1996 |
| JP | H08-118738 | A | 5/1996 |
| JP | 8-267839 | A | 10/1996 |
| JP | H08-290618 | A | 11/1996 |
| JP | 2596263 | | 4/1997 |
| JP | H09-118044 | A | 5/1997 |
| JP | H09-134557 | A | 5/1997 |
| JP | 9-141986 | A | 6/1997 |
| JP | H09-188049 | A | 7/1997 |
| JP | H09-188050 | A | 7/1997 |
| JP | 10-056604 | A | 2/1998 |
| JP | 10-181063 | A | 7/1998 |
| JP | H1-146945 | A | 2/1999 |
| JP | H11-78188 | A | 3/1999 |
| JP | H11-105351 | A | 4/1999 |
| JP | H11-129563 | A | 5/1999 |
| JP | H11-263055 | A | 9/1999 |
| JP | H11-263056 | A | 9/1999 |
| JP | 2000-006501 | A | 1/2000 |
| JP | 2998617 | | 1/2000 |
| JP | 2000025251 | A | 1/2000 |
| JP | 2000-043337 | A | 2/2000 |
| JP | 2000043336 | A | 2/2000 |
| JP | 2000085224 | A | 3/2000 |
| JP | 2000103129 | A | 4/2000 |
| JP | 2000103131 | A | 4/2000 |
| JP | 2000135843 | A | 5/2000 |
| JP | 2000198258 | A | 7/2000 |
| JP | 2001011594 | A | 1/2001 |
| JP | 2001048389 | A | 2/2001 |
| JP | 3207860 | B2 | 9/2001 |
| JP | 2001310540 | A | 11/2001 |
| JP | 2001319447 | A | 11/2001 |
| JP | 2002042441 | A | 2/2002 |
| JP | 2002104568 | A | 4/2002 |
| JP | 2002179300 | A | 6/2002 |
| JP | 2002192769 | | 10/2002 |
| JP | 2002308481 | A | 10/2002 |
| JP | 3357128 | | 12/2002 |
| JP | 2002367333 | A | 12/2002 |
| JP | 2003251902 | A | 9/2003 |
| JP | 2003285522 | A | 10/2003 |
| JP | 2004-155150 | A | 6/2004 |
| JP | 3543659 | B2 | 7/2004 |
| JP | 3564848 | B2 | 9/2004 |
| JP | 2004291591 | A | 10/2004 |
| JP | 2004323241 | A | 11/2004 |
| JP | 2005231203 | A | 9/2005 |

(56) References Cited

FOREIGN PATENT DOCUMENTS

| | | | |
|---|---|---|---|
| JP | 2005280008 | A | 10/2005 |
| JP | 2005297348 | | 10/2005 |
| JP | 4061507 | | 11/2005 |
| JP | 2006096030 | | 4/2006 |
| JP | 2006142835 | A | 6/2006 |
| JP | 2006182034 | A | 7/2006 |
| JP | 2006248059 | A | 9/2006 |
| JP | 2006272895 | A | 10/2006 |
| JP | 2006272977 | A | 10/2006 |
| JP | 2006289991 | A | 10/2006 |
| JP | 2007-196654 | A | 8/2007 |
| JP | 4003068 | B2 | 11/2007 |
| JP | 2007296863 | A | 11/2007 |
| JP | 2008080668 | A | 4/2008 |
| JP | 2008083432 | | 4/2008 |
| JP | 2009028976 | A | 2/2009 |
| JP | 2009-509812 | A | 3/2009 |
| JP | 2011-011407 | A | 1/2011 |
| JP | 2011-110843 | A | 6/2011 |
| JP | 2011-110845 | A | 6/2011 |
| JP | 2011-110848 | A | 6/2011 |
| WO | 0032401 | A1 | 6/2000 |
| WO | 03080350 | A1 | 10/2003 |
| WO | 2005101306 | A1 | 10/2005 |
| WO | 2006024913 | A2 | 3/2006 |
| WO | 2006090842 | A1 | 8/2006 |
| WO | 2010113445 | A1 | 10/2010 |

OTHER PUBLICATIONS

Oct. 1, 2013 (JP) Office Action issued in Japanese Patent Application No. 2011547222.
Nov. 15, 2011 (JP) Office Action issued in Japanese Patent Application No. 2009-088241.
Jul. 10, 2012 (PCT) International Preliminary Report on Patentability issued in PCT/JP2009/070971.
Apr. 10, 2014 (CN) Office Action issued in Chinese Application No. 201010150109 [Correcting citation, "Office Action issued Apr. 1, 2001 in Chinese Application No. 20101015019" as submitted Jun. 10, 2014.]
May 20, 2010 (PCT) International Search Report in International Application No. PCT/JP2009/007086.
May 20, 2010 (PCT) International Search Report in International Application No. PCT/JP2009/007085.
Jul. 30, 2010 (PCT) International Search Report in International Application No. PCT/JP2010/002169.
Jul. 30, 2010 (PCT) International Search Report in International Application No. PCT/JP2010/002165.
Mar. 23, 2010 (PCT) International Search Report in International Application No. PCT/JP2009/071568.
May 21, 2010 (PCT) International Search Report in International Application No. PCT/JP2009/007089.
Jun. 22, 2010 (PCT) International Search Report in International Application No. PCT/JP2010/055324.
Jun. 22, 2010 (PCT) International Search Report in International Application No. PCT/JP2010/055326.
Mar. 16, 2010 (PCT) International Search Report in International Application No. PCT/JP2010/050253.
May 20, 2010 (PCT) International Search Report in International Application No. PCT/JP2009/007087.
Mar. 5, 2010 (PCT) International Search Report in International Application No. PCT/JP2009/007088.
Aug. 3, 2010 (PCT) International Search Report in International Application No. PCT/JP2010/002154.
Aug. 3, 2010 (PCT) International Search Report in International Application No. PCT/JP2010/002161.
Jun. 22, 2010 (PCT) International Search Report in International Application No. PCT/JP2010/055305.
Aug. 24, 2010 (PCT) International Search Report in International Application No. PCT/JP2010/004076.
Jun. 22, 2010 (PCT) International Search Report in International Application No. PCT/JP2010/055311.
Jun. 22, 2010 (PCT) International Search Report in International Application No. PCT/JP2010/055310.
Jun. 28, 2010 (PCT) International Search Report in International Application No. PCT/JP2010/002170.
Mar. 23, 2010 (PCT) International Search Report in International Application No. PCT/JP2009/070971.
May 21, 2010 Extended European Search Report in European Patent Application No. 09180351.
Jul. 2, 2010 Extended European Search Report in European Patent Application No. 10157994.
Jul. 12, 2010 Extended European Search Report in European Patent Application No. 10158024.
Oct. 12, 2010 Extended European Search Report in European Patent Application No. 10155348.
May 21, 2010 Extended European Search Report in European Patent Application No. 09180354.
Dec. 3, 2010 Extended European Search Report in European Patent Application No. 10175769.
Oct. 11, 2011 (JP) Office Action issued in Japanese Patent Application No. 2008-331634.
Oct. 11, 2011 (JP) Office Action issued in Japanese Patent Application No. 2009-088440.
Oct. 11, 2011 (JP) Office Action issued in Japanese Patent Application No. 2009-088227.
Oct. 11, 2011 (JP) Office Action issued in Japanese Patent Application No. 2009-088238.
Oct. 11, 2011 (JP) Office Action issued in Japanese Patent Application No. 2009-088441.
Oct. 11, 2011 (JP) Office Action issued in Japanese Patent Application No. 2009-088460.
Jan. 17, 2012 (JP) Office Action issued in Japanese Patent Application No. 2009-088456.
Feb. 14, 2012 (PCT) International Preliminary Report on Patentability in International Application No. PCT/JP2010/055305.
Feb. 14, 2012 (PCT) International Preliminary Report on Patentability in International Application No. PCT/JP2010/055311.
Mar. 16, 2010 (PCT) International Search Report and Written Opinion issued in International Application No. PCT/JP2009/071812.
Notice of Allowance issued in related U.S. Appl. No. 12/732,747 mailed Feb. 19, 2014.
Notice of Allowance issued in related U.S. Appl. No. 12/732,404 mailed Feb. 4, 2014.
Notice of Allowance issued in related U.S. Appl. No. 12/732,828 mailed Jan. 27, 2014.
Notice of Allowance issued in corresponding U.S. Appl. No. 12/644,451 mailed Feb. 24, 2014.
Japanese Office Action issue in Application No. 2011-507142 on Nov. 26, 2013.
European Office Action issued in Application No. 10711776.4 on Nov. 22, 2013.
New Zealand Office Action issue in Application No. 596044 on Nov. 8, 2013.
Japanese Office Action issue in Application No. 2011-507049 on Dec. 3, 2013.
Chinese Office Action issue in Application No. 200980161405.0 on Nov. 1, 2013.
Apr. 10, 2014 (CN) Office Action issued in Chinese Application No. 201010150109 [Correcting citation, "Office Action issued Apr. 1, 2001 in Chinese Application No. 20101015019" as submitted Jun. 11, 2014.]
Jul. 7, 2014 (US) Final Office Action issued in U.S. Appl. No. 13/430,080.
Jul. 22, 2014 (US) Office Action in U.S. Appl. No. 12/732,257.
Jul. 18, 2014 (US) Office Action in U.S. Appl. No. 13/431,350.
Jul. 8, 2014 (JP) Office Action issued in Japanese Patent Application No. 2013-153421.
Jul. 8, 2014 (JP) Office Action issued in Japanese Patent Application No. 2013-153495.
Jun. 27, 2014 (AU) Office Action issued in Australian Patent Application No. 2010231426.

(56) References Cited

OTHER PUBLICATIONS

Jun. 2, 2014 (AU) Office action issued in Australian Patent Application No. 2010231425.
Jul. 8, 2014 (CA) Office Action issued in Canadian Patent Application No. 2,755,882.
Jun. 20, 2014 (CN) Office action issued in Chinese Patent Application No. 201210070147.
Jun. 26, 2014 (CN) Office action issued in Chinese Patent Application No. 200980161405.
International Preliminary Report on Patentability in PCT/JP2009/071568 on Nov. 15, 2011.
International Preliminary Report on Patentability in PCT/JP2010/055324 on Nov. 15, 2011.
International Preliminary Report on Patentability in PCT/JP2010/055326 on Nov. 15, 2011.
International Preliminary Report on Patentability in PCT/JP20010/050253 on Nov. 15, 2011.
International Preliminary Report on Patentability in PCT/JP2010/050253 on Nov. 15, 2011.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
Japanese Office Action in JP 2009-086239 on May 8, 2012.
Japanese Office Action in JP 2009-086222 on Jun. 12, 2012.
International Preliminary Report on Patentability in PCT/JP2010/055310 in Apr. 11, 2012.
U.S. Office Action issue in U.S. Appl. No. 13/934,512 on Nov. 19, 2013.
Non-Final Office Action received in corresponding U.S. Appl. No. 13/430,080 mailed Mar. 10, 2014.
Notice of Allowance issued in corresponding U.S. Appl. No. 13/240,266 mailed Mar. 27, 2014.
Notice of Allowance issued in corresponding U.S. Appl. No. 12/644,572 mailed Apr. 11, 2014.
Final Office Action received in corresponding U.S. Appl. No. 13/240,216 mailed May 7, 2014.
Notice of Allowance issued in U.S. Appl. No. 13/934,512 mailed May 6, 2014.
Non-Final Office Action received in corresponding U.S. Appl. No. 14/226,256 mailed May 22, 2014.
Office Action issued Apr. 1, 2014 in Japanese Application No. 2013-035990.
Office Action issued Mar. 13, 2014 in Chinese Application No. 201010150928.
Office Action issued Apr. 15, 2014 in Australian Application No. 2009332345.
Office Action issued Apr. 1, 2001 in Chinese Application No. 20101015019.
Office Action issued Apr. 2, 2014 in Chinese Application No. 201210070968.
Office Action issued Apr. 17, 2014 in Russian Application No. 2011143817.
Office Action issued May 9, 2014 in Vietnamese Application No. 1-2011-02491.
Mar. 25, 2014 Non-Final Office Action issued in U.S. Appl. No. 13/431,371.
Mar. 26, 2014 Final Office Action issued in U.S. Appl. No. 12/732,457.
Final Office Action issued Dec. 23, 2013 in U.S. Appl. No. 13/431,350.
Office Action issued in Chinese Patent Application 201010274378.2 dated Jan. 22, 2014.
Extended European Search Report issued Dec. 16, 2013 in EP App. No. 12160324.5.
Extended European Search Report issued Dec. 18, 2013 in EP App. No. 12160192.6.
Extended European Search Report issued Dec. 20, 2013 in EP App. No. 12161271.7.
Office Action issued Dec. 19, 2013 in Chinese Application No. 200910262674.8.
Office Action issued Jan. 17, 2014 in Chinese Application No. 201210071810.7.
Office Action issued Jan. 3, 2014 in Australian Application No. 2010231426.
Office Action issued Dec. 30, 2013 in Chinese Application No. 201010209208.6.
Office Action issued Dec. 30, 2013 in Chinese Application No. 201210070147.9.
Extended European Search Report issued Feb. 5, 2014 in EP App. No. 09852818.5.
May 21, 2014 (EP) Extended European Search Report issued in European Application No. 10758552.3.
May 6, 2014 (CN) Chinese Office Action issued in Chinese Application No. 201010150087.2.
May 6, 2014 (CN) Chinese Office Action issued in Chinese Application No. 201010150878.5.
May 13, 2014 (CN) Chinese Office Action issued in Chinese Application No. 201080013339.5.
Apr. 25, 2014 (MX) Mexican Office Action issued in Mexican Application No. MX/a/2011/013553.
Jun. 10, 2014 (JP) Japanese Office Action issued Japanese Application No. 2013-142488.
Jun. 24, 2014 (JP) Japanese Office Action issued Japanese Application No. 2013-153250.
Jun. 24, 2014 (JP) Japanese Office Action issued Japanese Application No. 2013-153340.
Dec. 5, 2014—(US) Non-Final Office Action—U.S. Appl. No. 14/226,325.
Dec. 1, 2014—(US) Non-Final Office Action—U.S. Appl. No. 14/226,289.
Nov. 4, 2014—(US) Non-Final Office Action—U.S. Appl. No. 14/226,367.
Nov. 4, 2014—(US) Non-Final Office Action—U.S. Appl. No. 14/226,428.
Nov. 5, 2014—(US) Non-Final Office Action—U.S. Appl. No. 14/226,373.
Nov. 25, 2014—(US) Notice of Allowance—U.S. Appl. No. 13/934,512.
Oct. 10, 2014—(US) Notice of Allowance—U.S. Appl. No. 12/732,457.
Oct. 30, 2014 (US) Final Office Action App—U.S. Appl. No. 14/226,256.
Dec. 16, 2014—(US) Notice of Allowance—U.S. Appl. No. 13/240,216.
Aug. 28, 2014—(US) Non-Final Office Action—U.S. Appl. No. 13/240,216.
Sep. 2, 2014—(US) Non-Final Office Action—U.S. Appl. No. 14/226,165.
Sep. 9, 2014—(US) Non-Final Office Action—U.S. Appl. No. 14/226,417.
Sep. 9, 2014—(US) Non-Final Office Action—U.S. Appl. No. 14/226,380.
Sep. 12, 2014—(US) Final Office Action—U.S. Appl. No. 13/431,371.
Sep. 12, 2014—(US) Non-Final Office Action—U.S. Appl. No. 14/226,386.
Sep. 22, 2014—(US) Non-Final Office Action—U.S. Appl. No. 14/141,673.
Sep. 25, 2014—(US) Non-Final Office Action—U.S. Appl. No. 14/226,424.
Oct. 2, 2014—(US) Non-Final Office Action—U.S. Appl. No. 13/430,033.
Sep. 24, 2014—(US) Notice of Allowance—U.S. Appl. No. 13/431,277.
Sep. 10, 2014—(US) Notice of Allowance—U.S. Appl. No. 13/934,512.

(56) References Cited

OTHER PUBLICATIONS

Sep. 11, 2014—(US) Non-Final Office Action—U.S. Appl. No. 13/848,750.
Jan. 22, 2015—(US) Notice of Allowance—U.S. Appl. No. 12/732,457.
Jan. 16, 2015—(US) Non-Final Office Action—U.S. Appl. No. 14/226,402.
Jan. 20, 2015—(US) Non-Final Office Action—U.S. Appl. No. 13/431,371.
Jan. 28, 2015—(US) Notice of Allowance—U.S. Appl. No. 13/431,277.
Nov. 12, 2014 (MX) Office Action in Application No. MX/a/2011/013553.
Dec. 26, 2014—(CN) Office Action in Application No. 201080013339.5.
Jan. 22, 2015—(US) Non-Final Office Action—U.S. Appl. No. 14/226,411.
Feb. 10, 2015—(US) Notice of Allowance—U.S. Appl. No. 14/226,380.
Dec. 16, 2014—(US) Non-Final Office Action—U.S. Appl. No. 14/226,259.
Jan. 2, 2015—(US) Non-Final Office Action—U.S. Appl. No. 14/226,262.
Jan. 5, 2015—(US) Non-final Office Action—U.S. Appl. No. 14/226,201.
Feb. 6, 2015—(EP) Extended Search Report—App. 14189221.6.
Jan. 29, 2015—(TW) Office Action—App 099132599.
Jan. 23, 2015 (AU) Office Action in Application No. 2010231426.
Mar. 6, 2015 (AU) Office Action in Application No. 2010231425.
Mar. 10, 2015 (JP) Office Action in Application No. 2014-095027.
Mar. 12, 2015 (EP) Search Report in Application No. 14156840.2.
Feb. 19, 2015 (CA) Office Action in Application No. 2755885.
Mar. 2, 2015 (TW) Office Action in Application No. 101110368.
Feb. 13, 2015—(US) Non-Final Office Action—U.S. Appl. No. 13/240,322.
Feb. 12, 2015—(US) Final Office Action—U.S. Appl. No. 12/732,257.
Feb. 12, 2015—(US) Final Office Action—U.S. Appl. No. 13/431,350.
Feb. 12, 2015—(US) Final Office Action—U.S. Appl. No. 14/226,417.
Feb. 17, 2015—(US) Final Office Action—U.S. Appl. No. 14/141,673.
Mar. 4, 2015—(US) Non-Final Office Action—U.S. Appl. No. 14/226,386.
Mar. 6, 2015—(US) Final Office Action—U.S. Appl. No. 14/226,424.
Mar. 17, 2015—(US) Notice of Allowance—U.S. Appl. No. 13/848,750.
Apr. 1, 2015—(US) Notice of Allowance—U.S. Appl. No. 12/732,457.
Apr. 1, 2015—(US) Notice of Allowance—U.S. Appl. No. 13/430,033.
Apr. 10, 2015—(US) Non-Final Office Action—U.S. Appl. No. 13/430,080.
Apr. 9, 2015—(US) Notice of Allowance—U.S. Appl. No. 13/431,277.
Mar. 13, 2015 (US) Notice of Allowance in U.S. Appl. No. 14/226,165.
Mar. 23, 2015 (US) Notice of Allowance in U.S. Appl. No. 13/934,512.
Apr. 14, 2015—(US) Notice of Allowance—U.S. Appl. No. 13/240,266.
Apr. 9, 2015—(US) Non-Final Office Action—U.S. Appl. No. 14/641,681.
Apr. 17, 2015—(US) Final Office Action—U.S. Appl. No. 14/226,367.
Apr. 21, 2015—(US) Final Office Action—U.S. Appl. No. 14/226,428.
May 1, 2015—(US) Notice of Allowance—U.S. Appl. No. 12/644,572.
May 6, 2015—(US) Final Office Action—U.S. Appl. No. 14/226,259.
May 6, 2015—(US) Final Office Action—U.S. Appl. No. 14/226,373.
Apr. 20, 2015 (AU) Office Action in Application No. 2010231426.
Apr. 7, 2015 (TW) Office Action in Application No. 99132600.
Apr. 2, 2015 (EP) Office Action in Application No. 10711776.4.
May 19, 2015—(US) Final Office Action—U.S. Appl. No. 14/226,289.
May 19, 2015—(US) Notice of Allowance—U.S. Appl. No. 14/226,201.
May 20, 2015—(US) Notice of Allowance—U.S. Appl. No. 13/848,750.
May 22, 2015—(US) Non-Final Office Action—U.S. Appl. No. 12/732,257.
May 29, 2015—(US) Notice of Allowance—U.S. Appl. No. 14/226,165.
Jun. 2, 2015—(US) Final Office Action—U.S. Appl. No. 14/226,262.
Jun. 5, 2015—(US) Notice of Allowance—U.S. Appl. No. 14/226,380.
Jun. 2, 2015—(US) Non-Final Office Action—U.S. Appl. No. 14/226,256.
Jun. 18, 2015—(US) Notice of Allowance—U.S. Appl. No. 12/732,457.
Apr. 13, 2015—(CN) Notification of Third Office Action—App 201210071810.7—Eng. Tran.
Apr. 9, 2015—(TW) Office Action—App 099132598—Eng. Tran.
Jun. 17, 2015—(US) Final Office Action—U.S. Appl. No. 14/226,325.
May 26, 2015—(CN) Office Action—App 201310659625.4.
Jun. 25, 2015—(US) Non-Final Office Action—U.S. Appl. No. 13/431,350.
Aug. 13, 2015—(US) Final Office Action—U.S. Appl. No. 13/431,371.
Jul. 31, 2015—(US) Final Office Action—U.S. Appl. No. 14/226,411.
Jun. 19, 2015 (CN) Notification of First Office Action—U.S. Appl. No. 201310659875.8—Eng Tran.
Jul. 7, 2015—(US) Notice of Allowance—U.S. Appl. No. 14/141,673.
Jul. 16, 2015—(US) Non-Final Office Action—U.S. Appl. No. 14/226,417.
Oct. 7, 2015—(US)—Final Office Action—U.S. Appl. No. 13/240,322.
Oct. 22, 2015—(US) Final Office Action—U.S. Appl. No. 14/641,681.
Oct. 23, 2015—(US) Final Office Action—U.S. Appl. No. 13/431,350.
Nov. 20, 2015—(KR) Office Action—App 10-2015-7006347.
Nov. 20, 2015—(KR) Office Action—App 10-2011-7017238.
Nov. 27, 2015—(CN) Office Action—App 201410311930.9.
Dec. 3, 2015—(CN) Office Action—App 201510088644.5.
Jan. 12, 2016—(US) Notice of Allowance—U.S. Appl. No. 13/431,371.
Jan. 15, 2016—(US) Notice of Allowance—U.S. Appl. No. 12/732,257.
Dec. 24, 2015—(TW) Decision of Rejection—App 101110368—Eng Tran.
Feb. 16, 2016—(US) Non-Final Office Action—U.S. Appl. No. 14/867,877.
Feb. 25, 2016—(US) Non-Final Office Action—U.S. Appl. No. 14/141,568.
Jan. 29, 2016—(US) Notice of Allowance—U.S. Appl. No. 14/226,411.
Feb. 5, 2016—(US) Non-Final Office Action—U.S. Appl. No. 13/240,322.
Mar. 29, 2016—(US) Notice of Allowance—U.S. Appl. No. 13/431,350.

* cited by examiner

TAPE CASSETTE

CROSS-REFERENCE TO RELATED APPLICATION

This application is a Continuation Application of U.S. Ser. No. 13/430,080 filed on Mar. 26, 2012, which is a continuation-in-part of International Application No. PCT/JP2009/070971, filed Dec. 16, 2009. The disclosure of the foregoing applications is herein incorporated by reference in its entirety.

BACKGROUND

The present invention relates to a tape cassette that can be freely inserted into and removed from a tape printer.

A tape cassette has been known that is configured to be freely inserted into and removed from a cassette housing portion of a tape printer. With this type of tape cassette, a tape that is a printing medium is housed in a box-shaped cassette case. Further, an arm portion for guiding the tape to a print position is provided such that it extends along a front surface of the tape cassette. To the rear of the arm portion, a long hole is formed that extends in the left-right direction of the cassette case and that penetrates the cassette case in the up-down direction. When the tape cassette is inserted in the tape printer, this long hole may function, for example, as a head insertion portion into which a thermal head is inserted.

SUMMARY

In the known tape cassette, the length of the long hole in the left-right direction is equal to or less than a distance from a right end of the tape cassette to a right end of the long hole. As a result, a center of the long hole in the left-right direction tends to be located further to the left than a center of the tape cassette in the left-right direction. In this case, the center of the long hole in the left-right direction tends to become separated from the center of gravity of the tape cassette in the left-right direction, and it may become difficult to obtain a balanced weight distribution. For that reason, when the tape cassette is housed in the tape printer or in a packaging box, for example, there may be a risk that the tape cassette tilts, resulting in a deterioration in printing quality and a deterioration in operation efficiency and so on.

Various exemplary embodiments of the general principles herein provide a tape cassette that has a favorable weight distribution.

Exemplary embodiments herein provide a tape cassette that includes a cassette case, a tape roll, an arm portion, and a long hole. The cassette case has a top surface, a bottom surface, a front surface, and a pair of side surfaces, and includes a top case and a bottom case. The top case has a top plate that forms the top surface, and the bottom case has a bottom plate that forms the bottom surface. The tape roll is a wound tape that is a printing medium and that is housed in the cassette case. The arm portion includes a part of the front surface and guides the tape toward a discharge opening along a section of a predetermined feed path, the section extending in parallel with the front surface. The long hole extends in a left-right direction of the cassette case to the rear of and adjacent to the arm portion, penetrates the cassette case in an up-down direction, and is formed straddling a center position of the cassette case in the left-right direction. In the tape cassette, a first distance, which is a length of the long hole in the left-right direction, is larger than a second distance, which is a length from an end portion of the tape cassette in an opposite direction to a feed direction of the tape that is fed in the arm portion, to an end portion of the long hole in the opposite direction. Further, a center of gravity of the tape cassette is located in a specific area, which is an area whose both end positions in the left-right direction are the same as both end positions of the long hole, and which extends in a front-rear direction of the tape cassette.

BRIEF DESCRIPTION OF THE DRAWINGS

Exemplary embodiments will be described below in detail with reference to the accompanying drawings in which.

DETAILED DESCRIPTION

Figure 1:
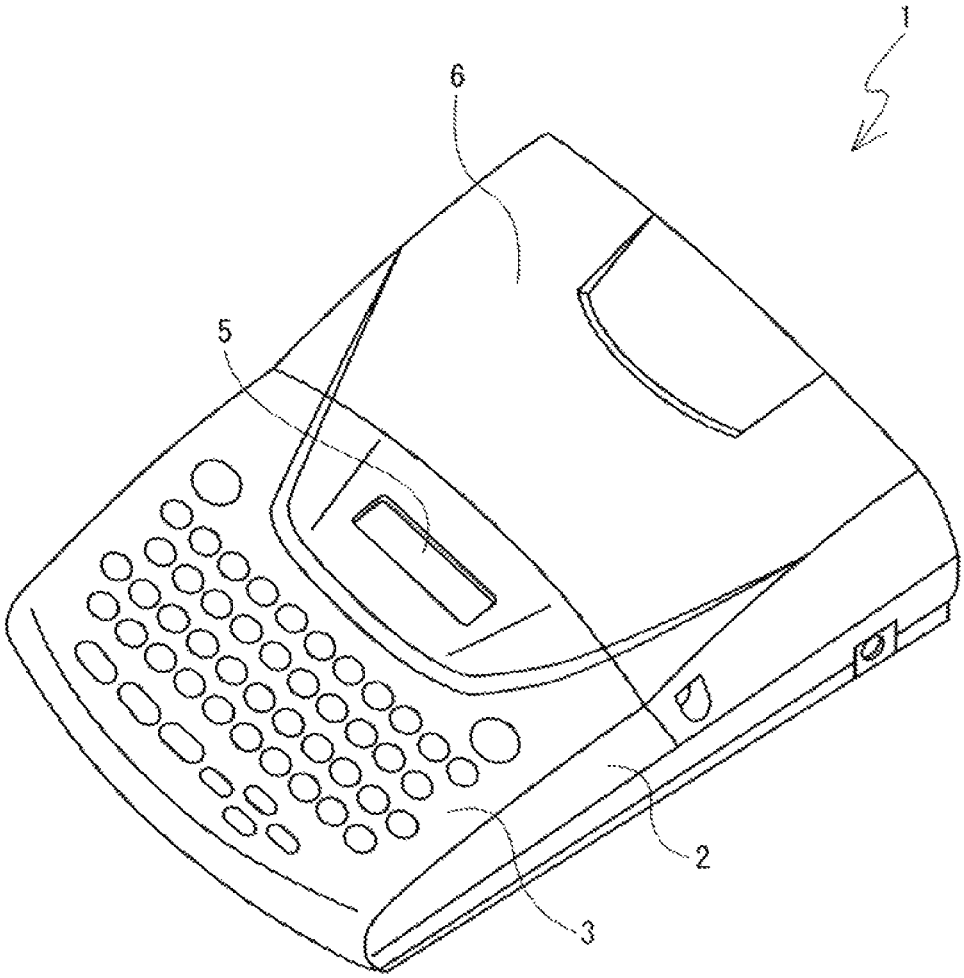
FIG. 1 is a perspective view of a tape printer 1, as seen from above, when a cassette cover 6 is in a closed state.

Exemplary embodiments of the present disclosure will be explained below, with reference to the drawings. Note that the drawings to which reference is made are used to explain the technical features that can be used by the present disclosure and are simply explanatory examples.

A tape printer 1 and a tape cassette 30 according to an embodiment will be explained hereinafter with reference to FIG. 1 to FIG. 26. In the following explanation, the lower left side, the upper right side, the lower right side and the upper left side in FIG. 1 and FIG. 2 respectively correspond to the front side, the rear side, the right side and the left side of the tape printer 1. In addition, the lower right side, the upper left side, the upper right side and the lower left side in FIG. 3 respectively correspond to the front side, the rear side, the right side and the left side of the tape cassette 30.

Note that, in FIG. 3 and FIG. 4 etc. that are used in the following explanation, where walls that form a periphery around a cassette housing portion 8 are shown, these drawings are simply schematic diagrams, and the walls shown in the drawings are depicted as thicker than they are in actuality. Furthermore, a group of gears, including gears 91, 93, 94, 97, 98 and 101, shown in FIG. 3, which is a perspective view showing the tape cassette 30 and the cassette housing portion 8, is covered and hidden in actuality by the bottom surface of a cavity 811. However, as it is necessary to explain the group of gears, the bottom surface of the cavity 811 is not shown in the drawings. Moreover, in FIG. 4 to FIG. 7 etc., the states in which the tape cassette 30 is inserted in the cassette housing portion 8 are shown with a top case 311 removed.

First, an outline structure of the tape printer 1 will be explained. The tape printer 1 is a general purpose tape printer, in which various types of tape cassette can be used, such as a thermal type, a receptor type, a laminated type and a heat sensitive laminated type. Note that the thermal type is a type of tape cassette in which only a heat sensitive paper tape is housed. The receptor type is a type of tape cassette in which a print tape and an ink ribbon are housed. The laminated type is a type of tape cassette in which a double-sided adhesive tape, a film tape and the ink ribbon are housed. The heat sensitive laminated type is a type of tape cassette in which the double-sided adhesive tape and the heat sensitive paper tape are housed.

Figure 2:
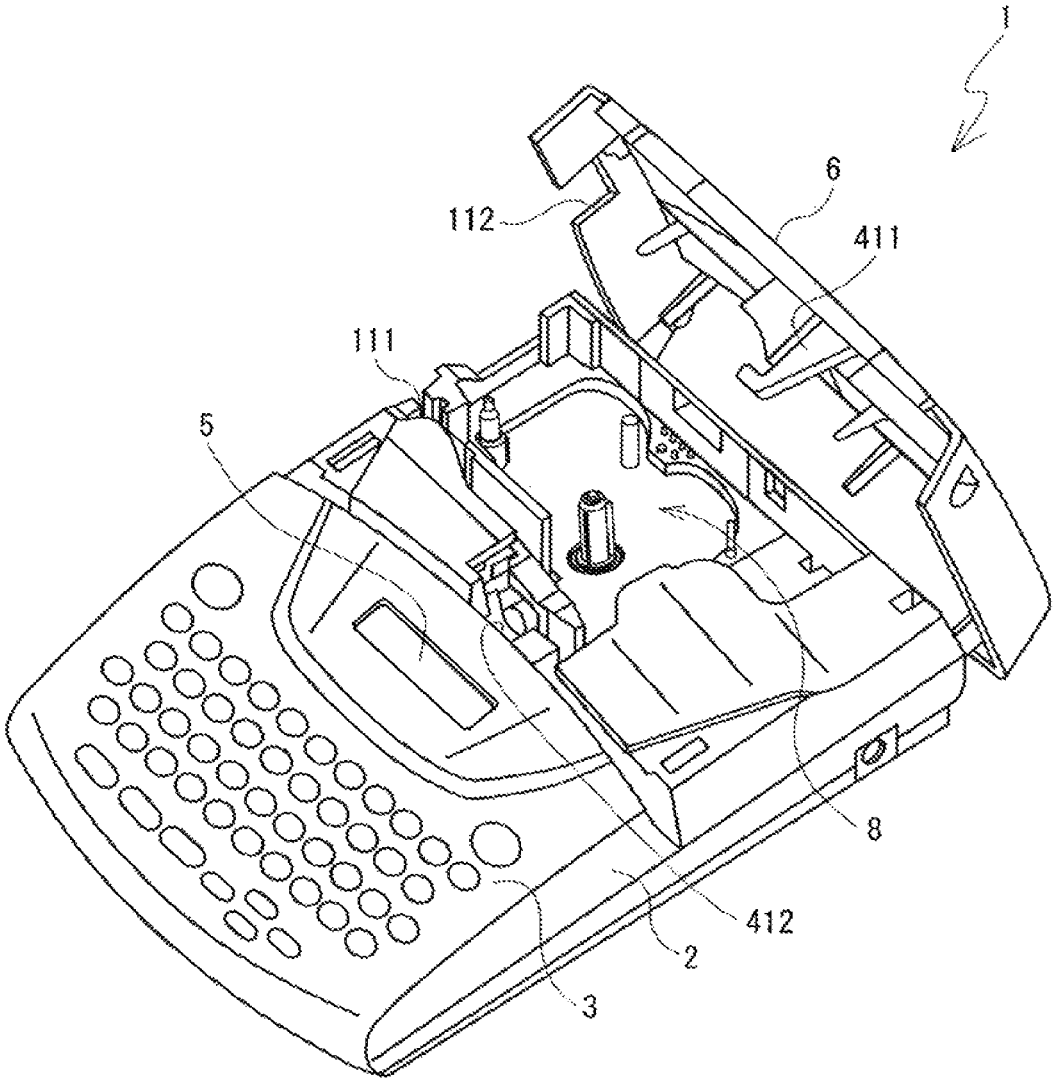
FIG. 2 is a perspective view of the tape printer 1, as seen from above, when the cassette cover 6 is in an open state.

As shown in FIG. 1 and FIG. 2, the tape printer 1 is provided with a main unit cover 2 that has a substantially parallelepiped shape. A keyboard 3 is provided on the front side of the main unit cover 2, the keyboard 3 including character keys such as characters, symbols and numerals, a variety of function keys and so on. On the rear side of the keyboard 3 is positioned a display 5 that can display input characters and symbols. On the rear side of the display 5 is provided a cassette cover 6 that can be opened and closed when replacing the tape cassette 30 (refer to FIG. 3). A discharge slit 111 is provided to the rear of the left side of the main unit cover 2, from which a printed tape is discharged to the outside. A discharge window 112 is formed on the left side surface of the cassette cover 6, such that, when the cassette cover 6 is in a closed state, the discharge slit 111 is exposed to the outside. The cassette housing portion 8 is provided in the interior of the main unit cover 02. A hook shaped engaging lock 411, which protrudes downward from a lower surface, is provided substantially in the center of the front surface of the cassette cover 6. A lock hole 412 is provided in the main unit cover 2, in a position corresponding to the engaging lock 411. When the cassette cover 6 is closed, the engaging lock 411 is latched into the lock hole 412, thus inhibiting the cassette cover 6 from spontaneously opening.

An internal structure of the main unit cover 2 under the cassette cover 6 will be explained with reference to FIG. 3 to FIG. 10. In FIG. 3 to FIG. 10, the internal structure of the main unit cover 2 (the shape and the structure of the cassette housing portion 8, in particular) is schematically shown, for ease of understanding. As shown in FIG. 3, the cassette housing portion 8 is an area in which the tape cassette 30 can be freely inserted or removed, and includes the cavity 811 and corner support portions 812. The cavity 811 is formed as a depression that substantially corresponds to the shape of a bottom surface 302 of a cassette case 31, and has a flat bottom surface. The corner support portions 812 are flat surface portions extending horizontally from outer edges of the cavity 811. The corner support portions 812 are portions that face lower surfaces of peripheral edges (more specifically, first to fourth corner portions 321 to 324) of the tape cassette 30 when the tape cassette 30 is inserted in the cassette housing portion 8.

Two positioning pins 102 and 103 are provided in two locations on the corner support portions 812. More specifically, the positioning pin 102 is provided on the left side of the cavity 811 and the positioning pin 103 is provided on the right side of the cavity 811, respectively. The positioning pins 102 and 103 are provided in positions such that, when the tape cassette 30 is inserted in the cassette housing portion 8, the positioning pins 102 and 103 respectively correspond to pin holes 62 and 63 (refer to FIG. 14) that are two indentations formed in a bottom case 312. When the tape cassette 30 is inserted in the cassette housing portion 8, the positioning pins 102 and 103 are respectively inserted into the pin holes 62 and 63 and positioning of the tape cassette 30 in the front-rear direction and the left-right direction is performed at left and right positions of the peripheral portion of the tape cassette 30.

A guide shaft 120, which may be inserted into and removed from a guide hole 47 that will be described later, is provided in a standing manner on the corner support portion 812 to the rear right side of the cassette housing portion 8. The guide shaft 120 is a shaft body that has a substantially cylindrical shape, and is formed of two shaft portions with differing diameters (a large diameter shaft portion 120A and a small diameter shaft portion 120B) and of a tapered portion 120C that connects the large diameter shaft portion. 120A and the small diameter shaft portion 120B (refer to FIG. 19). The large diameter shaft portion 120A is a shaft portion that forms a base end side of the guide shaft 120 and is the portion of the guide shaft 120 that has the largest diameter. The small diameter shaft portion 120B is a shaft portion that forms a leading end side of the guide shaft 120 and has a smaller diameter than the large diameter shaft portion 120A. The tapered portion 120C is provided between the large diameter shaft portion 120A and the small diameter shaft portion 120B such that the diameter of the tapered portion 120C decreases from the large diameter shaft portion 120A toward the small diameter shaft portion 120B, thus forming a taper-shaped inclined surface.

Figure 3:
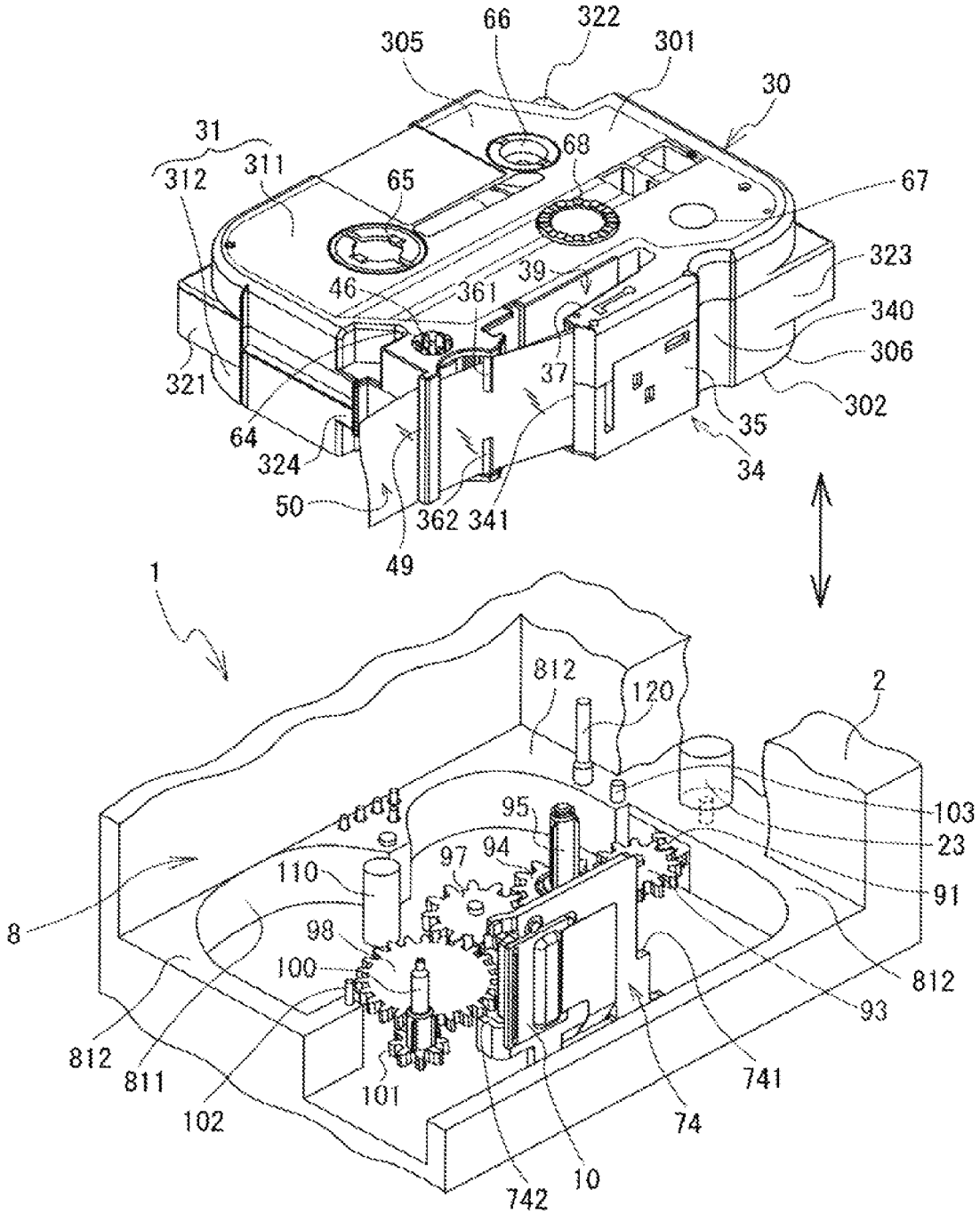
FIG. 3 is a perspective view for explaining a tape cassette 30 and a cassette housing portion 8.

As shown in FIG. 3, a head holder 74 is provided in a fixed condition on the front side of the cassette housing portion 8, and a thermal head 10 that is equipped with a heating element (not shown in the drawings) is mounted on the head holder 74. A tape feed motor 23 that is a stepping motor is provided on the outer side of the cassette housing portion 8 (the upper right side in FIG. 3). The gear 91 is anchored to the lower end of a drive shaft of the tape feed motor 23. The gear 91 is meshed with the gear 93 via an opening. The gear 93 is meshed with the gear 94. A ribbon take-up shaft 95 that is adapted to drive the rotation of a ribbon take-up spool 44, which will be described later (refer to FIG. 4), is provided in a standing manner on the upper surface of the gear 94. A plurality of cam members 95A that extend from the base end side to the leading end side of the shaft body of the ribbon take-up shaft 95 are provided on the ribbon take-up shaft 95 in a radial manner in a plan view (refer to FIG. 19). In addition, the gear 94 is meshed with the gear 97. The gear 97 is meshed with the gear 98. The gear 98 is meshed with the gear 101. A tape drive shaft 100 that is adapted to drive the rotation of a tape drive roller 46, which will be described later, is provided in a standing manner on the upper surface of the gear 101. A plurality of cam members 100A that extend from the base end side to the leading end side of the shaft body of the tape drive shaft 100 are provided on the tape drive shaft 100 in a radial manner in a plan view (refer to FIG. 19).

If the tape feed motor 23 drives the gear 91 to rotate in the counterclockwise direction, in a state in which the tape cassette 30 is inserted in the cassette housing portion 8, the ribbon take-up shaft 95 is driven to rotate in the counterclockwise direction via the gear 93 and the gear 94. The ribbon take-up shaft 95 causes the ribbon take-up spool 44, which is mounted on the ribbon take-up shaft 95, to rotate. Furthermore, the rotation of the gear 94 is transmitted to the tape drive shaft 100 via the gear 97, the gear 98 and the gear 101, and the tape drive shaft 100 is driven to rotate in the clockwise direction. The tape drive shaft 100 causes the tape drive roller 46, which is mounted on the tape drive shaft 100, to rotate. On the rear side of the gear 98, a substantially cylindrically shaped auxiliary shaft 110, which may be inserted into and removed from a first tape support hole 65 that will be described later, is provided in a standing manner.

As shown in FIG. 4 to FIG. 7, an arm-shaped platen holder 12 is provided on the front side of the head holder 74, the platen holder 12 being pivotably supported around a shaft support portion 121. On the leading end of the platen holder 12 are provided a platen roller 15 that is provided facing the thermal head 10 such that it can come into contact with and separate from the thermal head 10, and a movable feed roller 14 that is provided facing the tape drive roller 46, in which the tape drive shaft 100 may be inserted, such that the movable feed roller 14 can come into contact with and separate from the tape drive roller 46.

A release lever, which is not shown in the drawings, that moves in the left-right direction in response to the opening and closing of the cassette cover 6 is coupled to the platen holder 12. When the cassette cover 6 is opened, the release lever moves in the right direction, and the platen holder 12 moves toward the stand-by position shown in FIG. 4. In the stand-by position shown in FIG. 4, the platen holder 12 has moved in the direction separating it from the cassette housing portion 8, and the tape cassette 30 can therefore be inserted into or removed from the cassette housing portion 8. Note that the platen holder 12 is constantly elastically urged to remain in the stand-by position by a coil spring that is not shown in the drawings.

Figure 5:
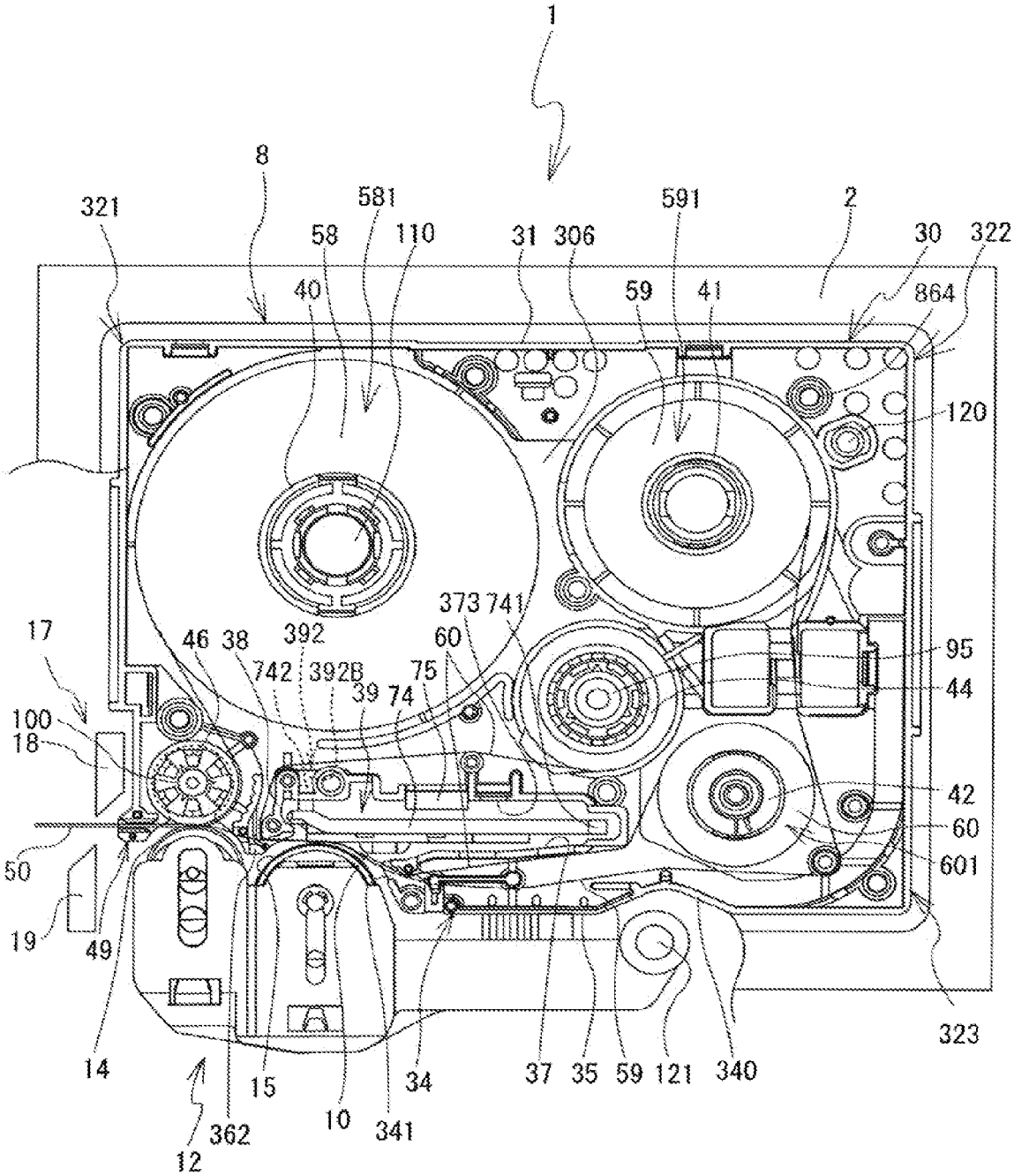
FIG. 5 is a plan view of the cassette housing portion 8 with the laminated type tape cassette 30 inserted, when the platen holder 12 is in a print position.
Figure 6:
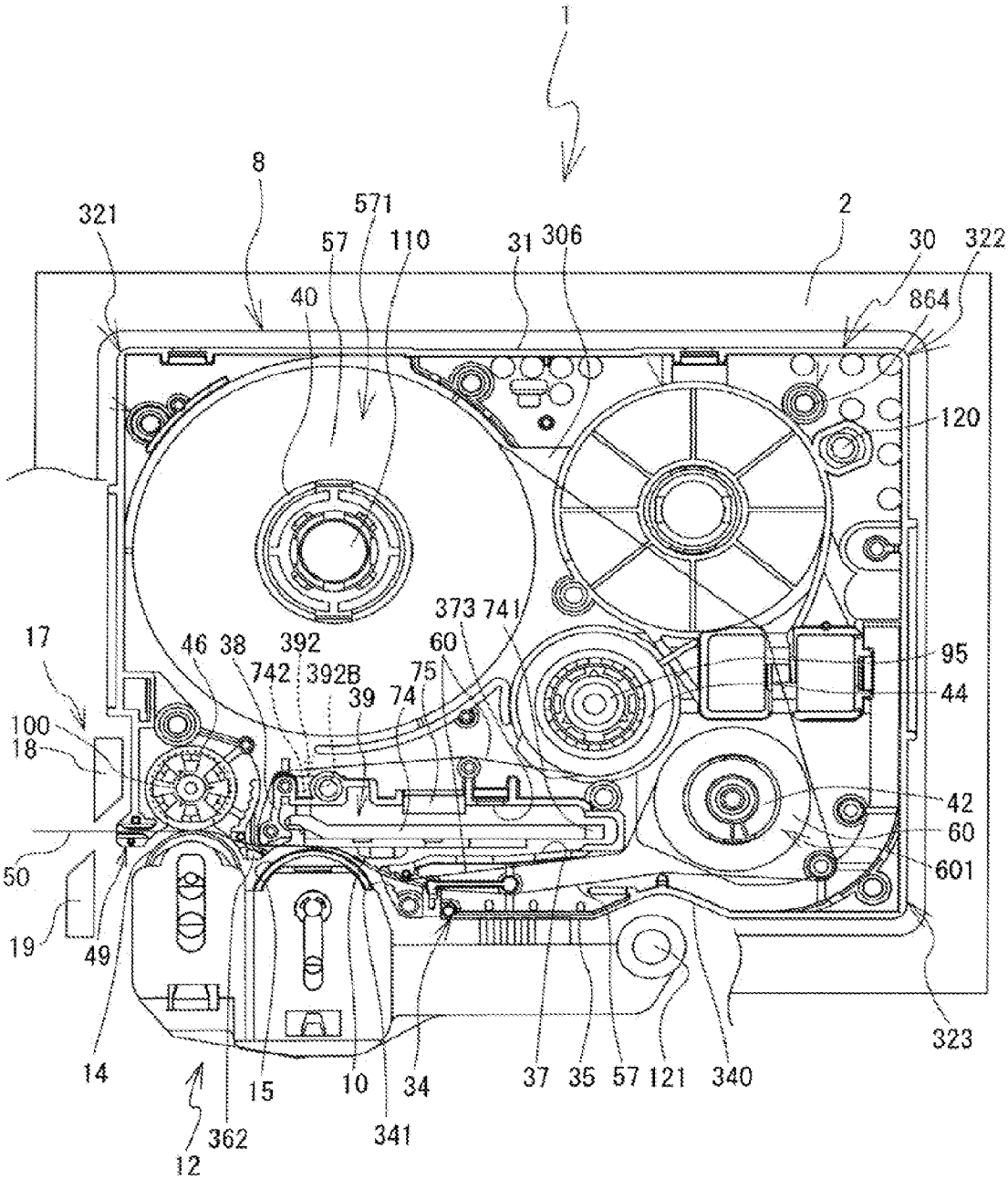
FIG. 6 is a plan view of the cassette housing portion 8 with the receptor type tape cassette 30 inserted, when the platen holder 12 is in the print position.
Figure 7:
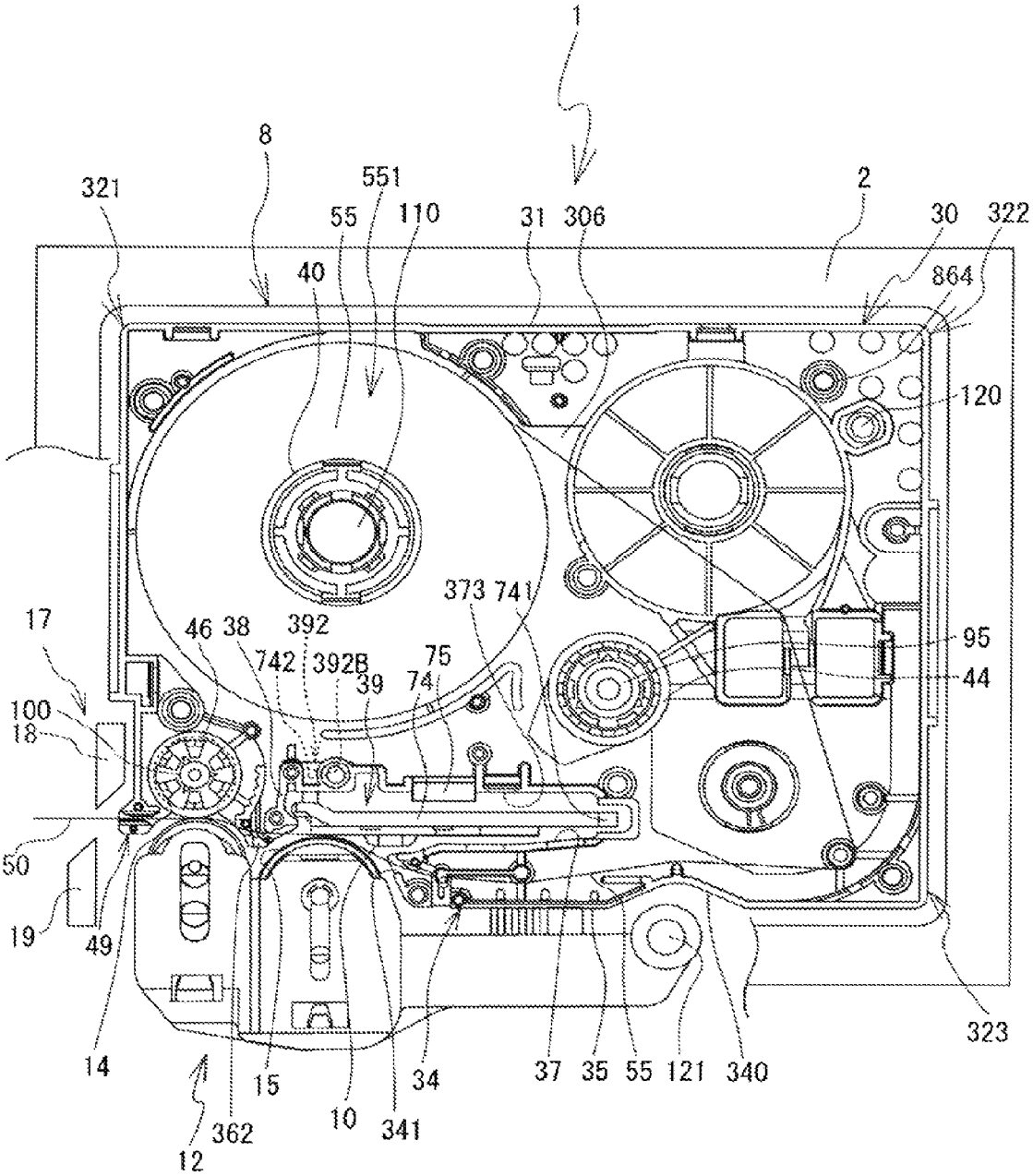
FIG. 7 is a plan view of the cassette housing portion 8 with the thermal type tape cassette 30 inserted, when the platen holder 12 is in the print position.

On the other hand, when the cassette cover 6 is closed, the release lever moves in the left direction and the platen holder 12 moves toward the print position shown in FIG. 5 to FIG. 7. In the print position shown in FIG. 5 to FIG. 7, the platen holder 12 has moved in the direction that brings it into proximity of the cassette housing portion 8. As shown in FIG. 5, when the laminated type tape cassette 30 is inserted in the cassette housing portion 8, the platen roller 15 presses the thermal head 10 via a film tape 59 and an ink ribbon 60. At the same time, the movable feed roller 14 presses the tape drive roller 46 via a double-sided adhesive tape 58 and the film tape 59.

As shown in FIG. 6, when the receptor type tape cassette 30 is inserted, the platen roller 15 presses the thermal head 10 via a print tape 57 and the ink ribbon 60. At the same time, the movable feed roller 14 presses the tape drive roller 46 via the print tape 57. As shown in FIG. 7, when the thermal type tape cassette 30 is inserted, the platen roller 15 presses the thermal head 10 via a heat-sensitive paper tape 55. At the same time, the movable feed roller 14 presses the tape drive roller 46 via the heat-sensitive paper tape 55.

In this way, in the print position shown in FIG. 5 to FIG. 7, printing can be performed using the tape cassette 30 inserted in the cassette housing portion 8. Note that the heat-sensitive paper tape 55, the print tape 57, the double-sided adhesive tape 58, the film tape 59 and the ink ribbon 60 will be explained in more detail later.

Figure 4:
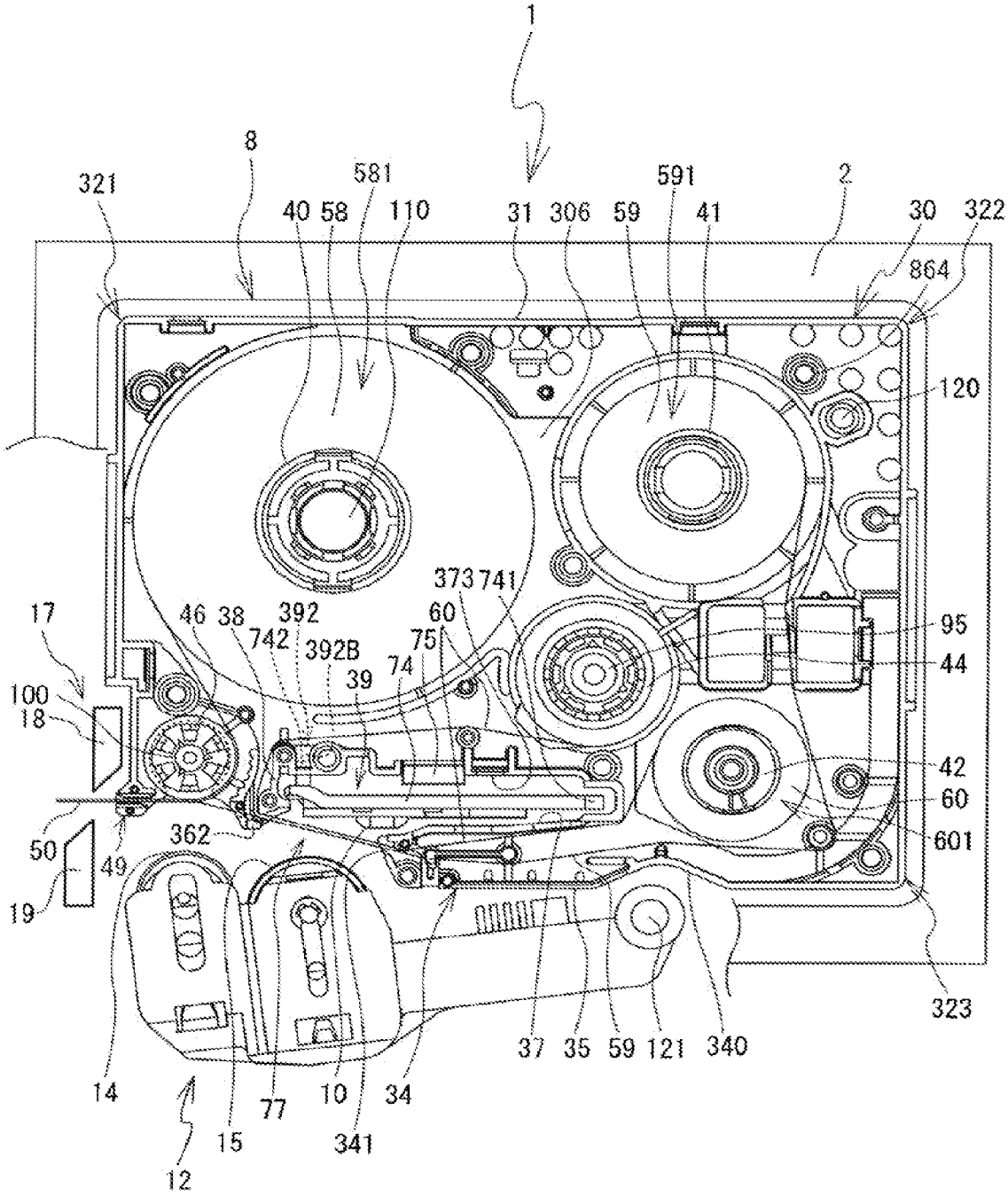
FIG. 4 is a plan view of the cassette housing portion 8 with the laminated type tape cassette 30 inserted, when a platen holder 12 is in a stand-by position.

As shown in FIG. 4, a feed path, through which a printed tape 50 is fed, is provided from a tape discharge portion 49 of the tape cassette 30 to the discharge slit 111 (refer to FIG. 2) of the tape printer 1. A cutting mechanism 17 that is adapted to cut the printed tape 50 at a predetermined position is provided on the feed path. The cutting mechanism 17 includes a fixed blade 18, and a movable blade 19 that faces the fixed blade 18 and that is supported such that it can move in the front-rear direction (in the up-down direction shown in FIG. 4 to FIG. 7). Note that the movable blade 19 is moved in the front-rear direction by a cutter motor 24 (refer to FIG. 11).

Figure 8:
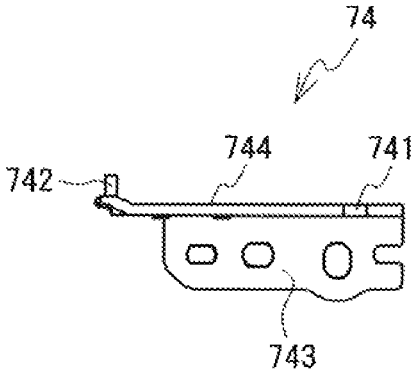
FIG. 8 is a plan view of a head holder 74.
Figure 9:
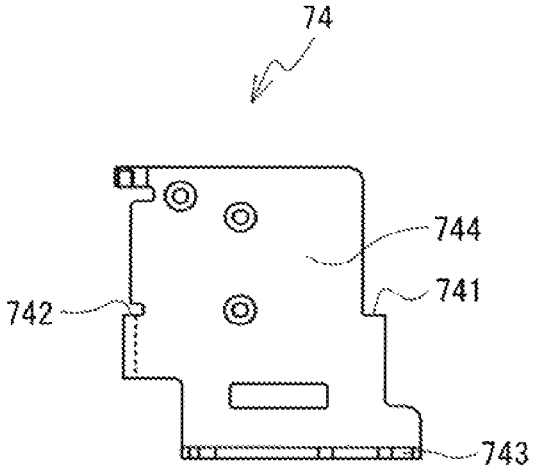
FIG. 9 is a front view of the head holder 74.
Figure 10:
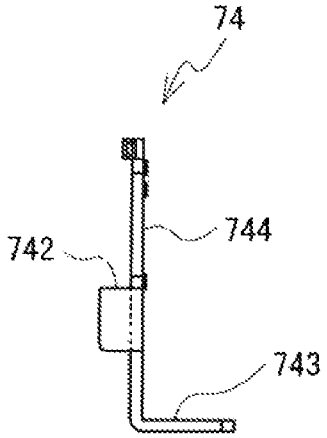
FIG. 10 is a left side view of the head holder 74.

A detailed structure of the head holder 74 will be explained with reference to FIG. 4 and FIG. 8 to FIG. 10. As shown in FIG. 8 to FIG. 10, the head holder 74 is formed from a single plate-shaped member and includes a base portion 743 and a head anchoring portion 744. The base portion 743 is fastened below the bottom face (not shown in the drawings) of the cavity 811. The head anchoring portion 744 is bent such that it is roughly orthogonal to and extends upward from the base portion 743, and it is disposed along the left-right direction of the tape printer 1. The head holder 74 is arranged in a position in the cassette housing portion 8 such that, when the tape cassette 30 is inserted, the position of the head holder 74 corresponds to a head insertion portion 39 that will be described later. The thermal head 10 is affixed to the front surface of the head anchoring portion 744.

On the head anchoring portion 744 is provided a stepped portion 741 that is a stepped portion that is formed at a specified height by cutting out a right edge portion of the head anchoring portion 744, in an L shape in a front view. As will be explained in more detail later, when the tape cassette 30 is inserted in the cassette housing portion 8, the head insertion portion 39 is appropriately guided by the head holder 74 that includes the stepped portion 741.

A cassette support portion 742 that is adapted to support, from below, the tape cassette 30 that is inserted in the tape printer 1, is also provided on the head anchoring portion 744. The cassette support portion 742 is an extending piece that has a rectangular shape in a side view, and that extends from the left edge of the head anchoring portion 744, while bending substantially perpendicularly with respect to the head anchoring portion 744 at a same position (height position) in the up-down direction as the stepped portion 741.

In other words, the stepped portion 741 and the cassette support portion 742 extend, in a plan view, in directions that are substantially orthogonal to each other. The cassette support portion 742 may support the tape cassette 30 at a predetermined height position on the downstream side of the thermal head 10 in the tape feed direction. The cassette support portion 742 is set at a position at a predetermined distance in the up-down direction from a central position of the thermal head 10 in the up-down direction. Accordingly, the cassette support portion 742 may perform positioning of the tape cassette 30 in the up-down direction in relation to the central position of the thermal head 10 in the up-down direction.

Figure 11:
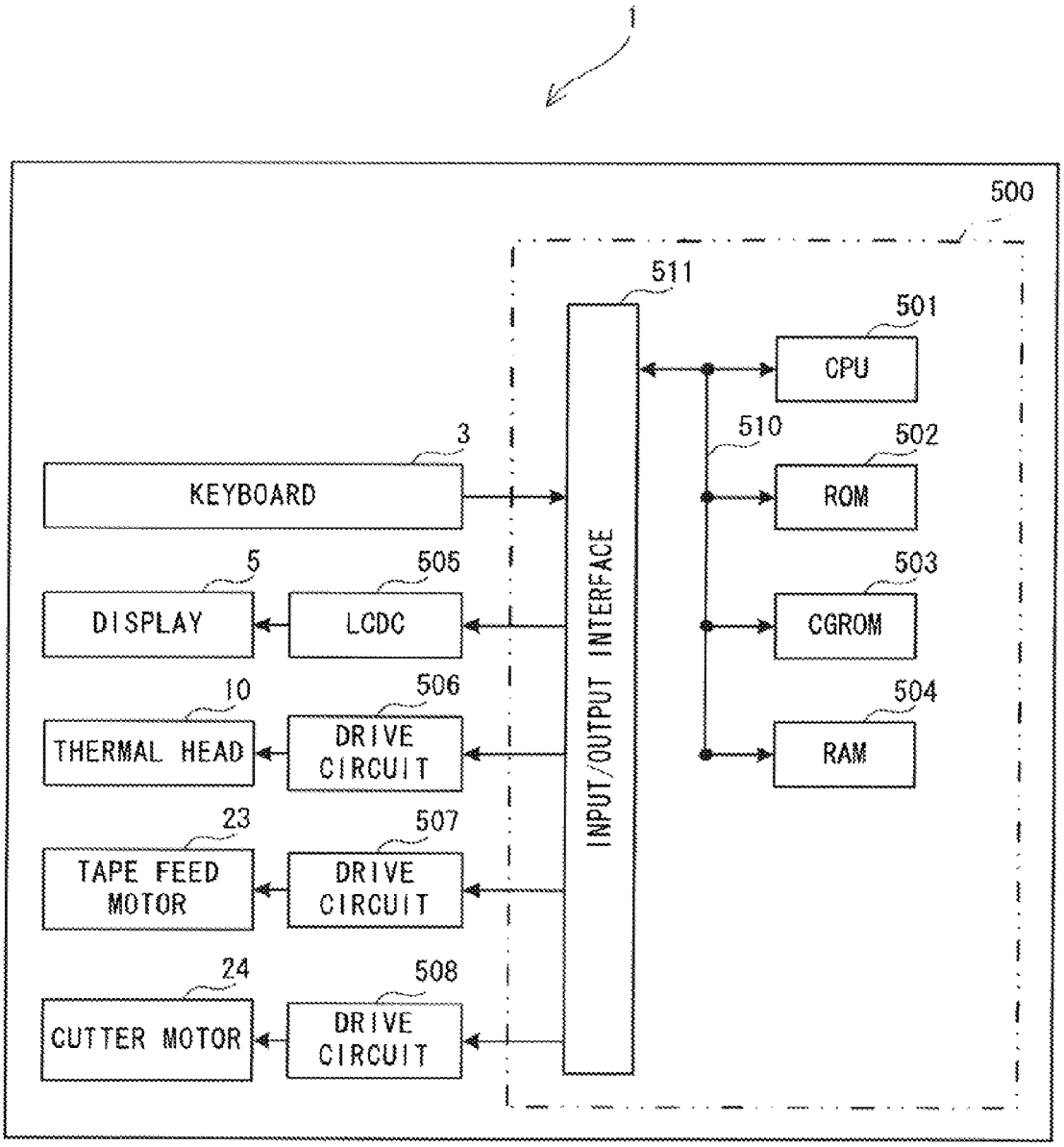
FIG. 11 is a block diagram showing an electrical configuration of the tape printer 1.

Next, the electrical configuration of the tape printer 1 will be explained with reference to FIG. 11. As shown in FIG. 11, the tape printer 1 includes a control circuit 500 formed on a control board. In the control circuit 500, a ROM 502, a CGROM 503, a RAM 504 and an input/output interface 511 are connected, via a data bus 510, to the CPU 501 that controls each instrument.

Various types of programs that are performed by the CPU 501 to control the tape printer 1 are stored in the ROM 502. Printing dot pattern data for printing characters is stored in the CGROM 503. A plurality of storage areas are provided in the RAM 504 for a text memory, a print buffer and the like.

The keyboard 3, the liquid crystal display (LCD) 5, drive circuits 506, 507, 508, and the like are connected to the input/output interface 511. The drive circuit 506 is an electronic circuit for driving the thermal head 10. The drive circuit 507 is an electronic circuit for driving the tape feed motor 23. The drive circuit 508 is an electronic circuit for driving the cutter motor 24, which operates the movable blade 19. A liquid crystal drive circuit (LCDC) 505 includes a video RAM (not shown in the drawings) for outputting display data to the display 5.

Next, the structure of the tape cassette 30 according to the present embodiment will be explained with reference to FIG. 3 to FIG. 7 and FIG. 12 to FIG. 18. Hereinafter, an example will be given of the tape cassette 30 that is configured as a general purpose cassette in which a variety of tape types can be housed, such as the thermal type, the receptor type and the laminated type that have been explained above, by changing, as appropriate, the tape type housed in the tape cassette 30 and the presence or absence of the ink ribbon and so on.

First, the overall structure of the tape cassette 30 will be explained. As shown in FIG. 3, the tape cassette 30 includes the cassette case 31 that is overall a substantially parallelepiped (box shaped) housing with corners that are rounded in a plan view. The cassette case 31 includes the bottom case 312, which includes a bottom plate 306 that forms the bottom surface 302 of the cassette case 31, and the top case 311, which includes a top plate 305 that forms a top surface 301 of the cassette case 31 and which is fixed to an upper portion of the bottom case 312. A distance from the bottom surface 302 to the top surface 301 is referred to as the height of the tape cassette 30 or of the cassette case 31.

In the cassette case 31 of the present embodiment, the whole perimeter of the top plate 305 and the bottom plate 306 is enclosed by a peripheral wall that forms side walls. However, the whole perimeter need not necessarily be enclosed, and an opening that exposes the interior of the cassette case 31 to the outside may be provided in a portion of the peripheral wall (a rear surface, for example), and bosses connecting the top plate 305 and the bottom plate 306 may be provided in positions facing the opening.

The cassette case 31 has four corner portions that have the same width (namely, the length is the same in the up-down direction), regardless of the type of the tape cassette 30. Hereinafter, the left rear corner portion will be called the first corner portion 321, the right rear corner portion will be called the second corner portion 322, the right front corner portion will be called the third corner portion 323, and the left front corner portion will be called the fourth corner portion 324. The first to fourth corner portions 321 to 324 protrude toward the outside from the side surfaces of the cassette case 31, such that they form right angles in a plan view. However, the left front fourth corner portion 324 does not form a right angle, because the tape discharge portion 49 is provided at that corner. Lower surfaces of the first to fourth corner portions 321 to 324 are portions that face the above-described corner support portions 812 when the tape cassette 30 is inserted in the cassette housing portion 8.

Figure 14:
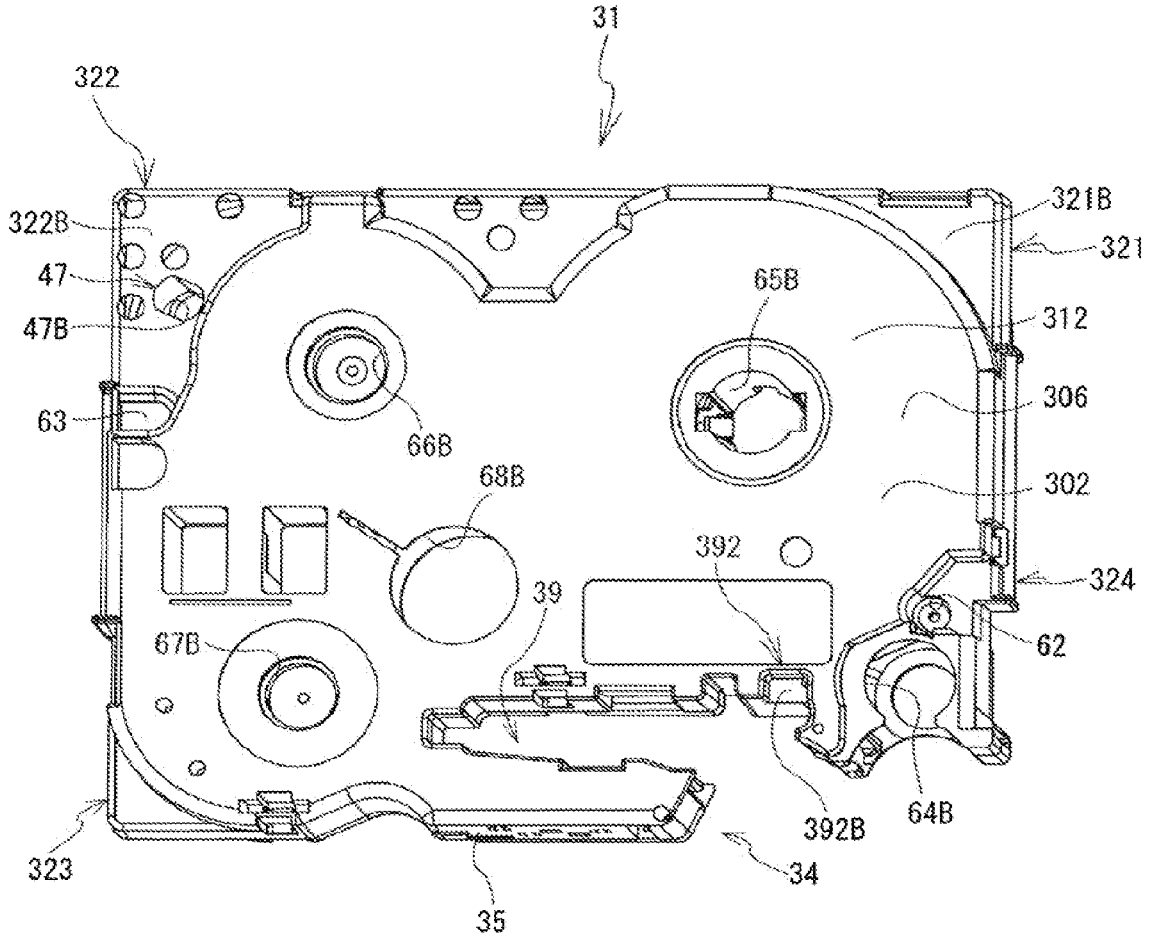
FIG. 14 is a perspective view of a bottom surface 302 of a cassette case 31, as seen from the front side.

As shown in FIG. 14, the pin holes 62 and 63, which correspond to the above-described positioning pins 102 and 103 of the tape printer 1, are provided in two locations on the lower surfaces of the second corner portion 322 and the fourth corner portion 324. More specifically, an indentation provided in the lower surface of the fourth corner portion 324 is the pin hole 62 into which the positioning pin 102 may be inserted. An indentation provided in the lower surface of the second corner portion 322 is the pin hole 63 into which the positioning pin 103 may be inserted.

Figure 12:
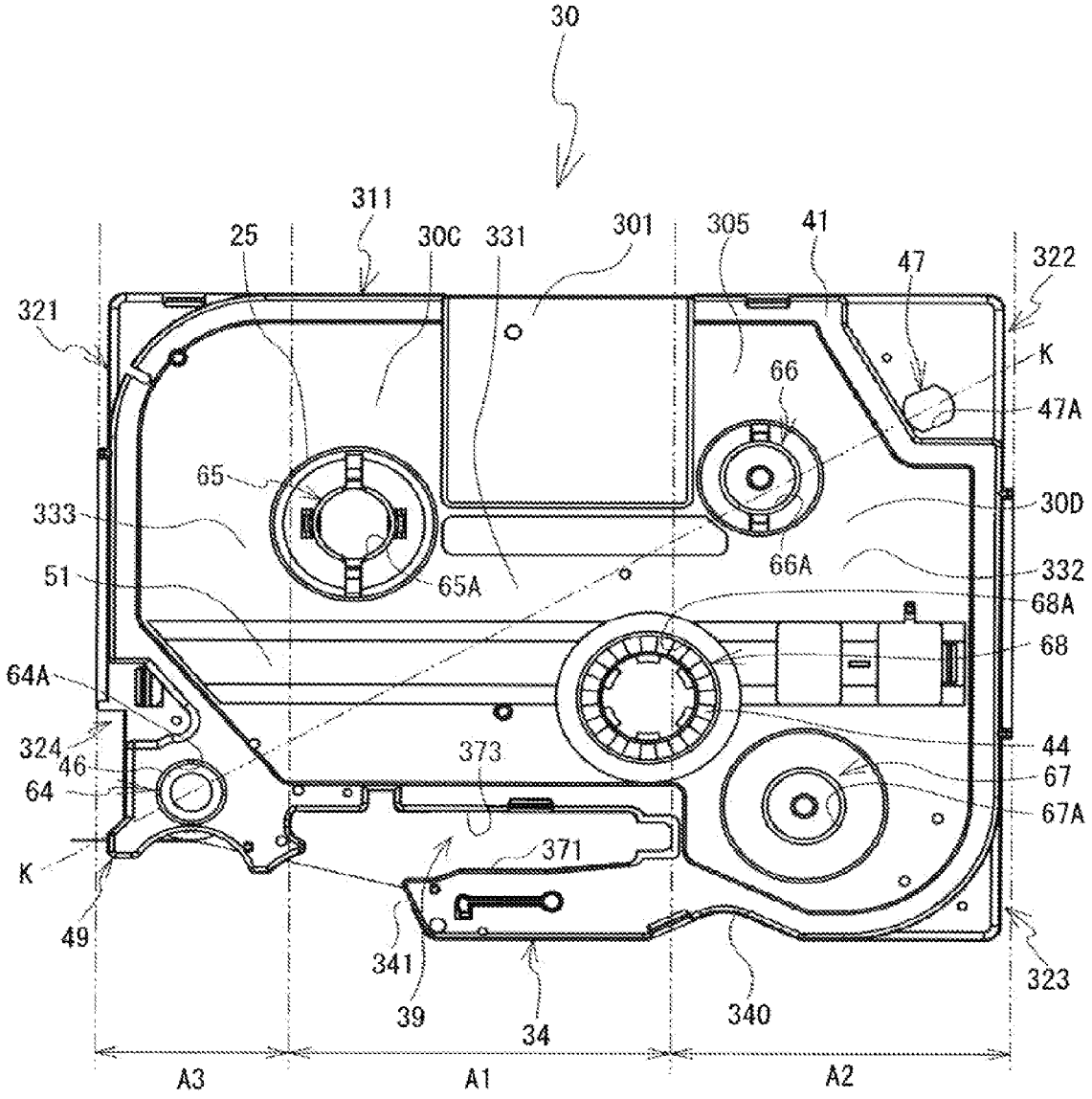
FIG. 12 is a plan view of the tape cassette 30.

As shown in FIG. 3, FIG. 4 and FIG. 12, the first tape support hole 65, which rotatably supports a first tape spool 40, is formed on the left and to the rear as seen from the center of the tape cassette 30 in the plan view. A second tape support hole 66, which rotatably supports a second tape spool 41, is formed on the right and to the rear as seen from the center of the tape cassette 30 in the plan view. A ribbon support hole 67, which rotatably supports a ribbon spool 42, is formed on the right and to the front as seen from the center of the tape cassette 30 in the plan view. Between the first tape support hole 65 and the ribbon support hole 67 is formed a take-up support hole 68 that rotatably supports the ribbon take-up spool 44, which is adapted to pull out the ink ribbon 60 from the ribbon spool 42 and also wind the ink ribbon 60 that has been used for printing characters etc.

With the laminated type tape cassette 30 shown in FIG. 4 and FIG. 5, three types of tape roll are housed in the cassette case 31, namely the tape rolls of the double-sided adhesive tape 58, which is a double-sided tape with a release paper affixed to one side, the transparent film tape 59, which is a printing medium, and the ink ribbon 60. A double-sided adhesive tape roll 581, which is the double-sided adhesive tape 58 that is wound with its release paper facing outward, is provided around the first tape spool 40. A film tape roll 591, which is the film tape 59 that is wound, is provided around the second tape spool 41. An ink ribbon roll 601, which is the unused ink ribbon 60 that is wound, is provided around the ribbon spool 42. The used ink ribbon 60 may be taken up by the ribbon take-up spool 44. A clutch spring (not shown in the drawings) is attached to a lower portion of the ribbon take-up spool 44 to inhibit loosening of the taken up ink ribbon 60 due to reverse rotation of the ribbon take-up spool 44.

With the receptor type tape cassette 30 shown in FIG. 6, two types of tape roll are housed in the cassette case 31, namely the tape rolls of the print tape 57, which is a printing medium, and the ink ribbon 60. A print tape roll 571, which is the print tape 57 that is wound, is provided around the first tape spool 40. The ink ribbon roll 601, which is the unused ink ribbon 60 that is wound, is provided around the ribbon spool 42. The receptor type tape cassette 30 does not include the second tape spool 41.

With the thermal type tape cassette 30 shown in FIG. 7, a single type of tape roll is housed in the cassette case 31, namely, the tape roll of the heat-sensitive paper tape 55. A heat-sensitive paper tape roll 551, which is the heat-sensitive paper tape 55 that is wound, is provided around the first tape spool 40. The thermal type tape cassette 30 does not include the second tape spool 41 and the ribbon spool 42. Hereinafter, any one of the heat-sensitive paper tape 55, the print tape 57 and the film tape 59, which are the printing medium, are simply referred to as the tape.

As shown in FIG. 3, a semi-circular groove 340 that is a groove portion forming a generally semi-circular shape in a plan view is provided in the front surface of the cassette case 31, and extends across the height direction of the cassette case 31 (in other words, extends from the top surface 301 to the bottom surface 302). The semi-circular groove 340 is a recess provided such that, when the tape cassette 30 is inserted in the cassette housing portion 8, there is no interference between the shaft support portion 121, which is the center of rotation of the platen holder 12, and the cassette case 31.

Of the front surface wall of the cassette case 31, the section that extends to the left from the semi-circular groove 340 is referred to as an arm front surface wall 35. A part that extends from the right side of the tape cassette 30 toward the left and that is defined by the arm front surface wall 35 and an arm back surface wall 37 that is positioned separately to the arm front surface wall 35 in the rearward direction and extending in the height direction, is referred to as an arm portion 34. The left end of the arm front surface wall 35 is bent toward the rear, and a gap that is formed between the arm front surface wall 35 and the left end of the arm back surface wall 37 and that extends in the up-down direction is a discharge opening 341, through which the tape (and the ink ribbon 60) is discharged from the arm portion 34.

As shown in FIG. 4 to FIG. 7, in the arm portion 34, the tape that is pulled from the first tape spool 40 or the second tape spool 41 is guided along a feed path that extends substantially parallel to the arm front surface wall 35, and is discharged from the discharge opening 341. Further, the ink ribbon 60 that is pulled from the ribbon spool 42 is guided inside the arm portion 34 along a different feed path to that of the tape, and is discharged from the discharge opening 341 in a state in which it is overlaid with the tape.

A space that is defined by the arm back surface wall 37 and by a head peripheral wall 373 which is provided contiguously from the arm back surface wall 37, that is a generally rectangular shape in a plan view and that penetrates the tape cassette 30 in the up-down direction, is the head insertion portion 39. The head insertion portion 39 corresponds to a "long hole" of the present disclosure. The head insertion portion 39 is connected to the outside at the front side of the tape cassette 30 through an opening 77 formed in the front side of the tape cassette 30. The head holder 74 that supports the thermal head 10 of the tape printer 1 may be inserted into the head insertion portion 39. At the opening 77 (refer to FIG. 4 to FIG. 7), printing is performed by the thermal head 10 using the ink ribbon 60 on the tape that is discharged from the discharge opening 341 of the arm portion 34. The head insertion portion 39 will be explained in more detail later.

As shown in FIG. 4 to FIG. 7 and in FIG. 14, support reception portions that may be used to determine the position of the tape cassette 30 in the up-down direction when the tape cassette 30 is inserted in the tape printer 1 are provided on the outer periphery of the head insertion portion 39 in the bottom case 312, in positions facing the head insertion portion 39. More specifically, a support reception portion 392 is provided on the downstream side of an insertion position (more specifically, the print position) of the thermal head 10 (refer to FIG. 4 to FIG. 7) in relation to the feed direction of the tape. The support reception portion 392 is contiguous to the downstream side end of the head insertion portion 39. The support reception portion 392 is a recessed portion formed by indenting the bottom surface 302 of the bottom plate 306 in the upward direction. The support reception portion 392 is also indented from the head insertion portion 39 in a direction that is orthogonal to the arm front surface wall 35.

The support reception portion 392 has a lower side flat surface portion 392B that is a lower side surface of a flat surface portion (a bottom portion of the recessed portion), that is positioned above the bottom surface 302, and that has a substantially rectangular shape in a bottom view. The position of the lower side flat surface portion 392B in the up-down direction (the height direction) of the bottom case 312 and a central position in the width direction of the tape and the ink ribbon 60 housed in the cassette case 31 are constant, irrespective of the type of the tape cassette 30, that is to say irrespective of a difference in the height, in the up-down direction, of the tape cassette 30. Thus, the wider the width of the housed tape and of the ink ribbon 60 of the tape cassette 30, the greater the depth of the support reception portion 392, which is the recessed portion provided in the bottom surface 302.

The lower side flat surface portion 392B may function as a part that is supported, from underneath, by the cassette support portion 742 provided on the head holder 74.

As shown in FIG. 3, a pair of regulating members 361 and 362 that match in the up-down direction are provided on the downstream side of the head insertion portion 39 in the tape feed direction. The regulating members 361 and 362 guides the tape that has been discharged from the discharge opening 341 and on which printing has been performed toward the tape discharge portion 49 on the downstream side of the thermal head 10. As will be described in more detail later, the ink ribbon 60 that has been used for printing is separated on the upstream side of the regulating members 361 and 362 and is fed along a separate feed path and taken up by the ribbon take-up spool 44.

Figure 13:
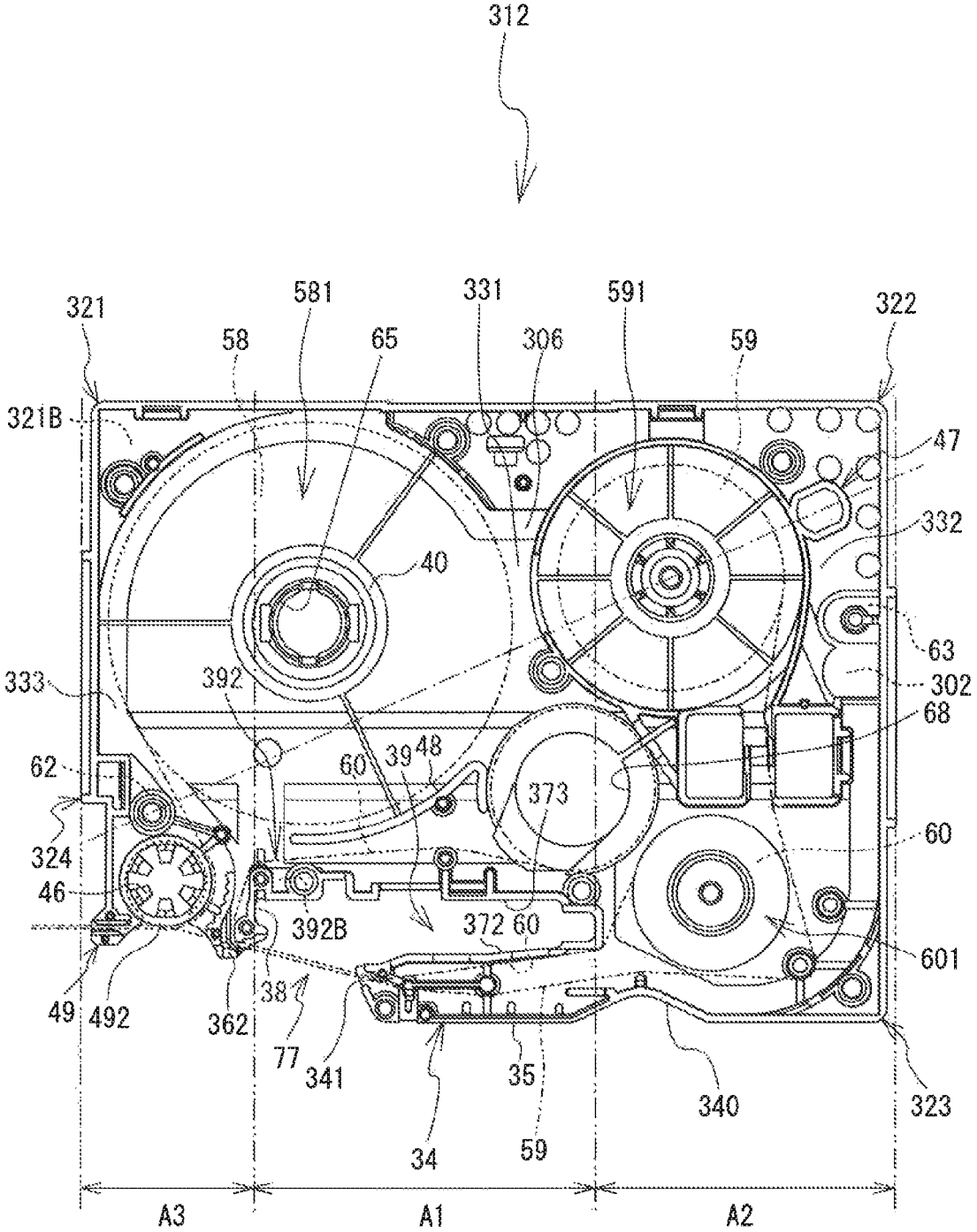
FIG. 13 is a plan view of a bottom case 312.

As shown in FIG. 13, a left side wall of the head peripheral wall 373 that defines the downstream side end of the head insertion portion 39 in the tape feed direction, is referred to as a ribbon guide wall 38. The ribbon guide wall 38 is in adjacent to and on the upstream side of the regulating member 362. The feed path of the ink ribbon 60 reaches from the ink ribbon roll 601 to the ribbon take-up spool 44, via the arm portion 34 and the opening 77. The ribbon guide wall 38 causes the ink ribbon 60, which has been used for printing at the opening 77, to bend along the feed path and guides the used ink ribbon 60 toward the ribbon take-up spool 44. The support reception portion 392 that is provided contiguously to the downstream side end of the head insertion portion 39 is positioned further toward the front than the feed path of the ink ribbon 60 that reaches from the ribbon guide wall 38 to the ribbon take-up spool 44.

Figure 27:
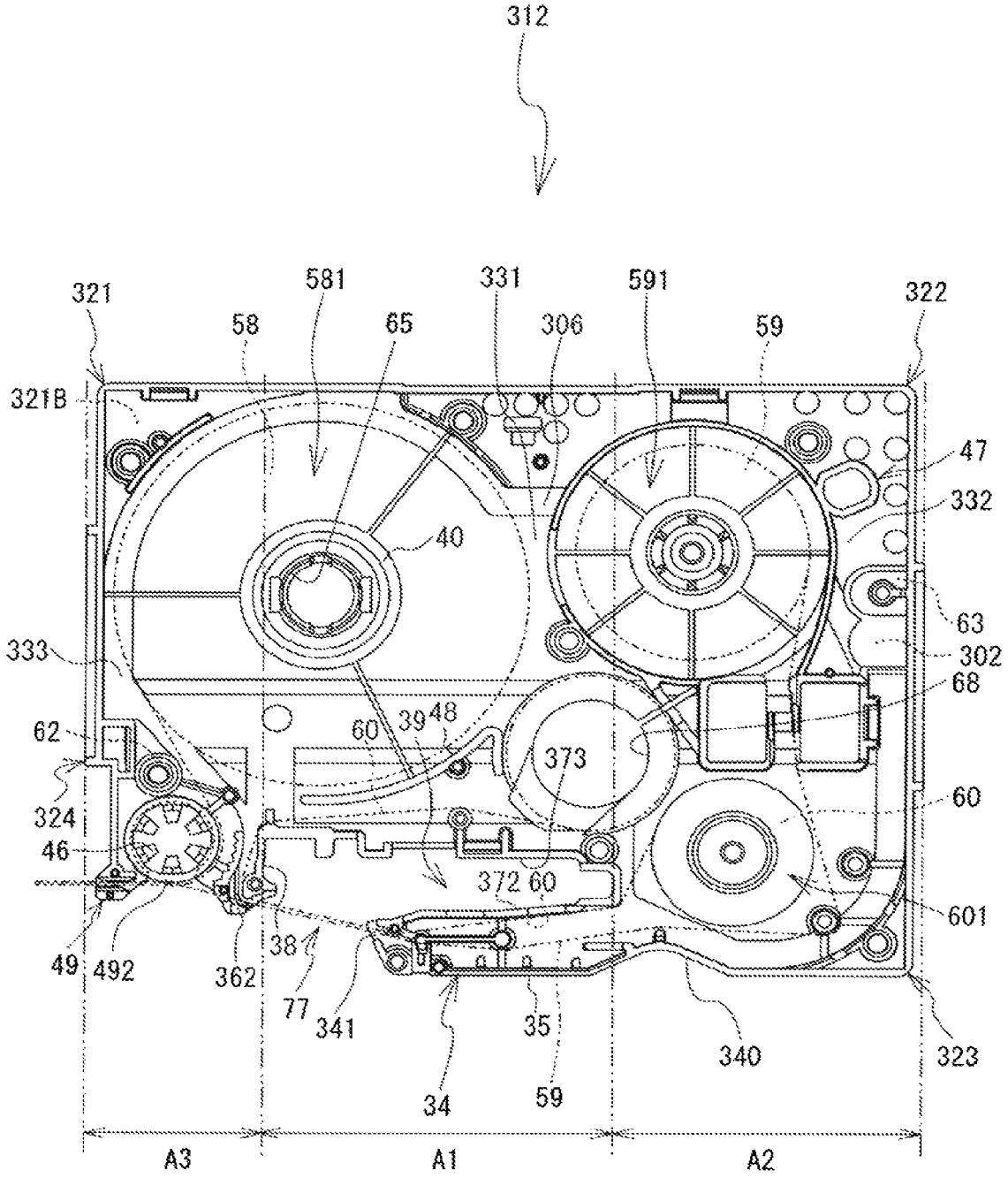
FIG. 27 is a plan view of the bottom case 312 according to a modified example.
Figure 28:
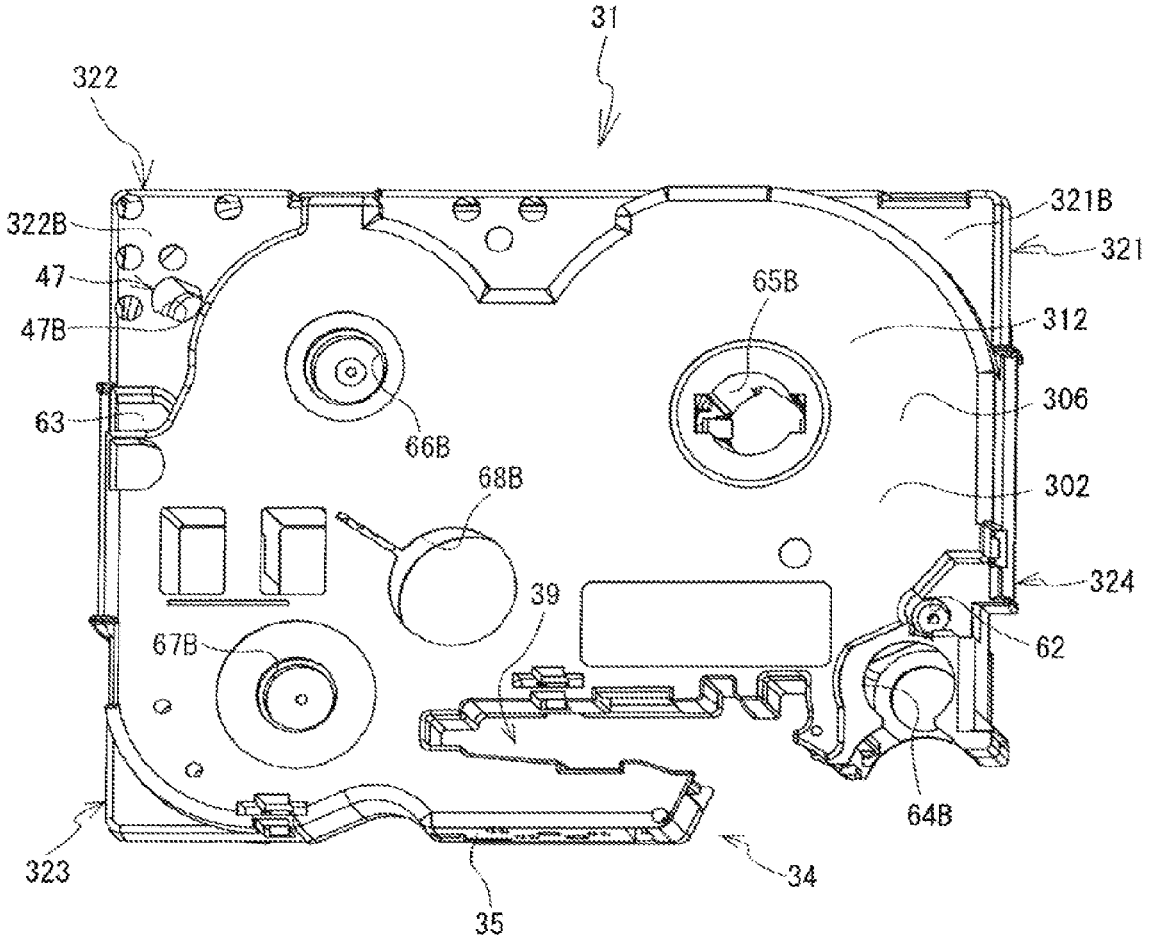
FIG. 28 is a perspective view, as seen from the front side, of the bottom surface 302 of the cassette case 31 according to the modified example.

Here, as shown in FIG. 27 and FIG. 28, the tape cassette 30 can have a structure that does not have the support reception portion 392. In this case, in place of the support reception portion 392 that functions as the part that is supported, from underneath, by the cassette support portion 742 which is provided on the head holder 74 when the tape cassette 30 is inserted in the cassette housing portion 8, the pin hole 62 may function as a part that is supported by the positioning pin 102 shown in FIG. 3, as will be described later.

Note that, as shown in FIG. 13, a separating wall 48 is provided in a standing manner between the ribbon guide wall 38 and the ribbon take-up spool 44. The separating wall 48 inhibits mutual contact between the used ink ribbon 60 that is guided along the ribbon guide wall 38 and the double-sided adhesive tape roll 581 that is provided around the first tape spool 40.

As shown in FIG. 3, a roller support hole 64 is provided on the downstream side of the regulating members 361 and 362 in the tape feed direction, and the tape drive roller 46 is rotatably supported inside the roller support hole 64. In other words, the roller support hole 64 is provided in the front left portion of the tape cassette 30.

When the laminated type tape cassette 30 shown in FIG. 4 and FIG. 5 is inserted in the cassette housing portion 8, the tape drive roller 46, by moving in concert with the facing movable feed roller 14, pulls the film tape 59 from the film tape roll 591, and also pulls the double-sided adhesive tape 58 from the double-sided adhesive tape roll 581. In addition, the tape drive roller 46 guides the double-sided adhesive tape 58 to the print surface of the film tape 59 and affixes the double-sided adhesive tape 58 to the print surface, and then feeds them toward the tape discharge portion 49 as the printed tape 50.

When the receptor type tape cassette 30 shown in FIG. 6 is inserted in the cassette housing portion 8, the print tape 57 is pulled from the print tape roller 571 by the tape drive roller 46 moving in concert with the movable feed roller 14. On the downstream side of the thermal head 10, the print tape 57 after printing, namely, the printed tape 50, is guided toward the tape discharge portion 49 by the regulating members 361 and 362. In addition, the used ink ribbon 60 that is fed via the head insertion portion 39 is separated from the print tape 57 on the upstream side of the regulating members 361 and 362, and is fed toward the ribbon take-up spool 44.

When the thermal type tape cassette 30 shown in FIG. 7 is inserted, the heat-sensitive paper tape 55 is pulled from the heat-sensitive paper tape spool 551 by the tape drive roller 46 moving in concert with the movable feed roller 14. On the downstream side of the thermal head 10, the heat-sensitive paper tape 55 after printing, namely, the printed tape 50, is guided toward the tape discharge portion 49 by the regulating members 361 and 362.

As shown in FIG. 3 and FIG. 13, the tape discharge portion 49 is provided slightly separated, in the forward direction, from a front end of the left side surface of the cassette case 31, and is a plate shaped member that extends between the top surface 301 and the bottom surface 302. The tape discharge portion 49 guides the printed tape 50, which is fed via the regulating members 361 and 362 and the tape drive roller 46, into a path formed between the tape discharge portion 49 and the front end of the left side surface of the cassette case 31, and discharges the printed tape 50 from a tape discharge opening provided at an end of the path.

Here, the head insertion portion 39 will be explained in more detail with reference to FIG. 12 and FIG. 13. As shown in FIG. 12 and FIG. 13, the head insertion portion 39 is formed straddling a center position in the left-right direction of the tape cassette 30. The left end portion of the head insertion portion 39 is formed by the ribbon guide wall 38. The left end portion of the head insertion portion 39 is positioned, in the left-right direction, further to the left than a center of the first tape support hole 65, which has a substantially circular shape in the plan view. The right end portion of the head insertion portion 39 is positioned, in the left-right direction, further to the right than a center of the take-up support hole 68, which has a substantially circular shape in the plan view.

As shown in FIG. 12 and FIG. 13, the length of the head insertion portion 39 in the left-right direction is referred to as a first distance A1. Further, an area that has the same length, in the left-right direction, as the first distance A1, of which both ends in the left-right direction are positioned in line with those of the head insertion portion 39, and that extends in the front-rear direction of the tape cassette 30, is referred to as a first area 331. Namely, the centers of the first tape support hole 65 and the take-up support hole 68 are positioned in the first area 331.

A distance from the right end portion of the head insertion portion 39 to the right end portion of the tape cassette 30 is referred to as a second distance A2. An area that has the same length, in the left-right direction, as the second distance A2, that is adjacent to the first area 331 on the right side, and that extends in the front-rear direction of the tape cassette 30, is referred to as a second area 332. A distance from the left end portion of the tape cassette 30 to the left end portion of the head insertion portion 39 is referred to as a third distance A3. An area that has the same length, in the left-right direction as the third distance A3, that is adjacent to the first area 331 on the left side, and that extends in the front-rear direction of the tape cassette 30, is referred to as a third area 333. In the present embodiment, the first distance A1 is larger than the second distance A2. The third distance A3 is smaller than the first distance A1 and the second distance A2. In other words, the first distance A1 is larger than the third distance A3.

In the receptor type and the laminated type tape cassette 30 shown in FIG. 4 to FIG. 6, the feed path of the ink ribbon 60 is in contact with a front portion of a right surface of the wall that forms the right end portion of the head insertion portion 39. More specifically, the ink ribbon 60 is pulled toward the front and the left from a rear left portion of the ink ribbon roll 601, comes into contact with the front portion of the right end portion of the head insertion portion 39 and is fed toward the left. In other words, the feed direction of the ink ribbon 60 is changed by coming into contact with the front portion of the wall that forms the right end portion of the head insertion portion 39. In this way, tension is applied to the ink ribbon 60 when the ink ribbon 60 is fed. Thus, there may be less risk of vibration etc. occurring in the ink ribbon 60 and feed accuracy may be improved. As a result, printing accuracy may be improved.

Next, hole portions (the first tape support hole 65, the take-up support hole 68, the roller support hole 64, the guide hole 47) that are formed in the tape cassette 30, and members related to these hole portions will be explained with reference to FIG. 15 to FIG. 18.

Figure 15:
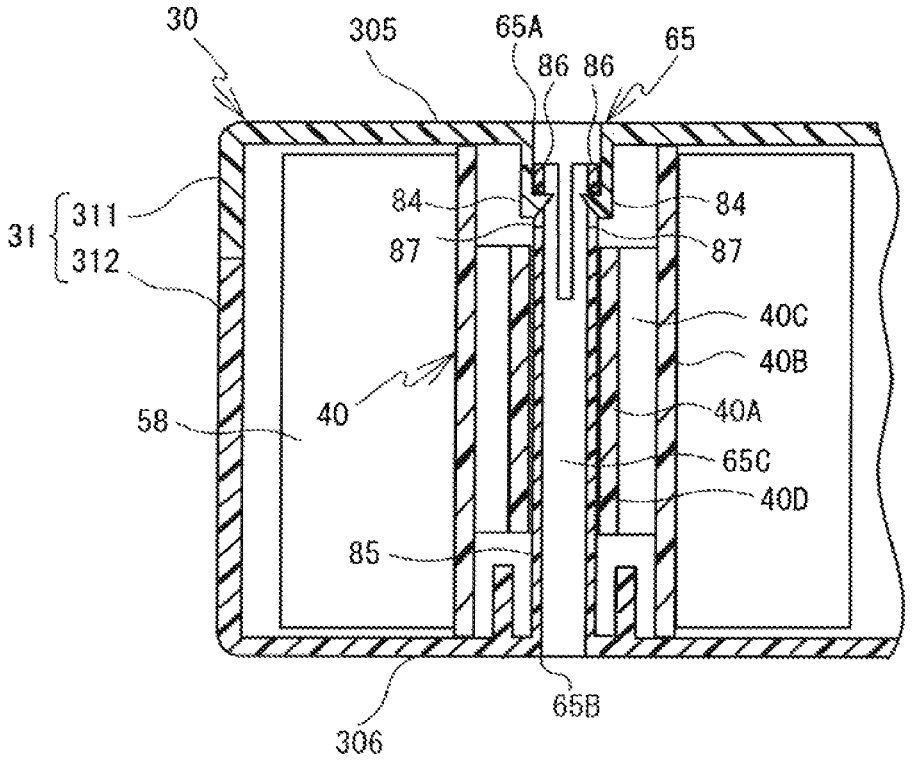
FIG. 15 is a front cross-sectional view of the tape cassette 30, centering on a first tape support hole 65 and a first tape spool 40.

As shown in FIG. 15, the first tape spool 40 is rotatably supported via the first tape support hole 65 that penetrates the cassette case 31 in the up-down direction. More specifically, the first tape support hole 65 is formed of an opening 65A and an opening 65B, which are concave holes that are provided facing each other and extending from the top plate 305 and the bottom plate 306, respectively, and a shaft hole 65C that links the openings 65A and 658. The top case 311 is provided with a plurality of engaging ribs 84 that extend from the opening 65A toward the bottom plate 306 and that are provided in a radial manner from the center of the opening 65A in the plan view. Each of the engaging ribs 84 is a hook shaped body, and the leading ends of the engaging ribs 84 protrude in directions mutually facing each other inside the cassette case 31. The bottom case 312 is provided with a cylindrically-shaped cylindrical wall portion 85 that extends from the opening 65B toward the top plate 305. A plurality of slits 87 are formed in the cylindrical wall portion 85 that are notched into the cylindrical wall portion 85 in the up-down direction and that are provided in a radial manner from the center of the opening 65B in the plan view. Head portions 86 are respectively provided on the upper ends of each of the slits 87 in the cylindrical wall portion 85 in order to close an opening end of each of the slits 87. Inside the cassette case 31, each of the head portions 86 provided on the leading end of the cylindrical wall portion 85 engages with each of the engaging ribs 84, via each of the slits 87. Note that inside the cylindrical wall portion 85, the shaft hole 65C that penetrates the cassette case 31 in the up-down direction links the openings 65A and 65B.

The first tape spool 40 has a double wall structure, with an inner wall 40A and an outer wall 40B. The inner wall 40A is a cylindrical body having an inner diameter that is slightly larger than an outer diameter of the cylindrical wall portion 85. The height of the inner wall 40A is smaller than the width of the tape or the double-sided adhesive tape 58 that is provided around the first tape spool 40. A shaft hole 40D is formed inside the inner wall 40A, penetrating the inner wall 40A in the up-down direction. The outer wall 40B is a cylindrical body that is provided on the radially outside of the inner wall 40A and that encircles the whole periphery of the inner wall 40A, and has a height that is substantially the same as the width of the tape or the double-sided adhesive tape 58. In the case of the laminated type tape cassette 30 shown in FIG. 4 and FIG. 5, the double-sided adhesive tape roll 581 is provided around the outer wall 40B. Connecting bodies 40C, which are a plate shaped members whose longitudinal direction is the up-down direction, are provided in a radial manner from the center of the inner wall 40A and the outer wall 40B in the plan view, between the inner wall 40A and the outer wall 40B. Due to the connecting bodies 40C, the first tape spool 40 is formed in a double cylindrical shape in which the inner wall 40A and the outer wall 40B have a same axis. While being axially supported by the cylindrical body 85 that is inserted into the shaft hole 40D, the first tape spool 40 is rotatable around an axis line inside the cassette case 31. Note that, in the first tape spool 40, in order to minimize a degree of play in the circumferential direction that may occur with respect to the auxiliary shaft 110 that is inserted into the shaft hole 65C, the opening width of the shaft hole 65C is substantially equal to or is slightly larger than the shaft diameter of the auxiliary shaft.

Figure 16:
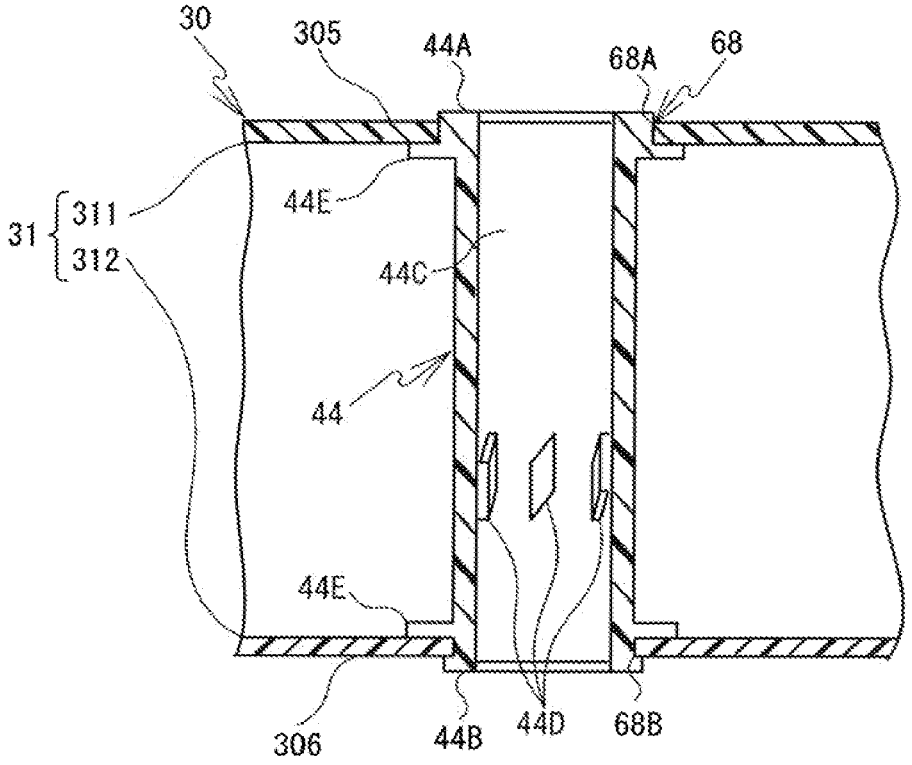
FIG. 16 is a front cross-sectional view of the tape cassette 30, centering on a take-up support hole 68 and a ribbon take-up spool 44.

As shown in FIG. 16, the ribbon take-up spool 44 is rotatably supported via the take-up support hole 68 that penetrates the cassette case 31 in the up-down direction. More specifically, the take-up support hole 68 is formed of an opening 68A and an opening 68B, which are through holes provided in positions facing each other in the top plate 305 and the bottom plate 306, respectively. The ribbon take-up spool 44 has a cylindrical shape that has approximately the same height as the width of the cassette case 31 (namely, the length of the cassette case 31 in the up-down direction). Flange-shaped support portions 44E are provided at an upper end edge and a lower end edge of the outer peripheral surface of the ribbon take-up spool 44, the support portions 44E each protruding in a radially outward direction around the whole periphery.

Inside the cassette case 31, an upper end portion 44A is fitted into the opening 68A of the top plate 305, and at the same time, a bottom end portion 44B is fitted into the opening 68B of the bottom plate 306. The support portion 44E that is provided on the upper end edge of the ribbon take-up spool 44 contacts the top case 311 from underneath and thus regulates the movement of the ribbon take-up spool 44 in the upward direction. The support portion 44E that is provided on the lower end edge of the ribbon take-up spool 44 contacts the bottom case 312 from above and thus regulates the movement of the ribbon take-up spool 44 in the downward direction. In this way, the ribbon take-up spool 44 is supported by both the end portions 44A and 44B while being rotatable around an axis line inside the cassette case 31.

A shaft hole 44C is formed inside the ribbon take-up spool 44, penetrating the ribbon take-up spool 44 in the up-down direction. A plurality of engaging ribs 44D are provided on an inner peripheral surface (namely, an inner wall forming the shaft hole 44C) of the ribbon take-up spool 44, the engaging ribs 44D being slightly lower than a center position in the up-down direction of the ribbon take-up spool 44. When the tape cassette 30 is inserted in the cassette housing portion 8, the above-described ribbon take-up shaft 95 is inserted into the shaft hole 44C via the opening 68B. Then, the plurality of cam members 95A that are formed around the periphery of the ribbon take-up shaft 95 mesh with the plurality of engaging ribs 44D that are provided on the ribbon take-up spool 44. In this way, the rotation of the ribbon take-up shaft 95 is transmitted to the ribbon take-up spool 44. More specifically, the ribbon take-up spool 44 rotates in accordance with the rotation of the ribbon take-up shaft 95. Note that the opening width of the shaft hole 44C is larger than the shaft diameter of the ribbon take-up shaft 95, in order that, when the ribbon take-up shaft 95 is mounted, some play may exist in the ribbon take-up spool 44 with respect to the ribbon take-up shaft 95 in the circumferential direction.

Figure 17:
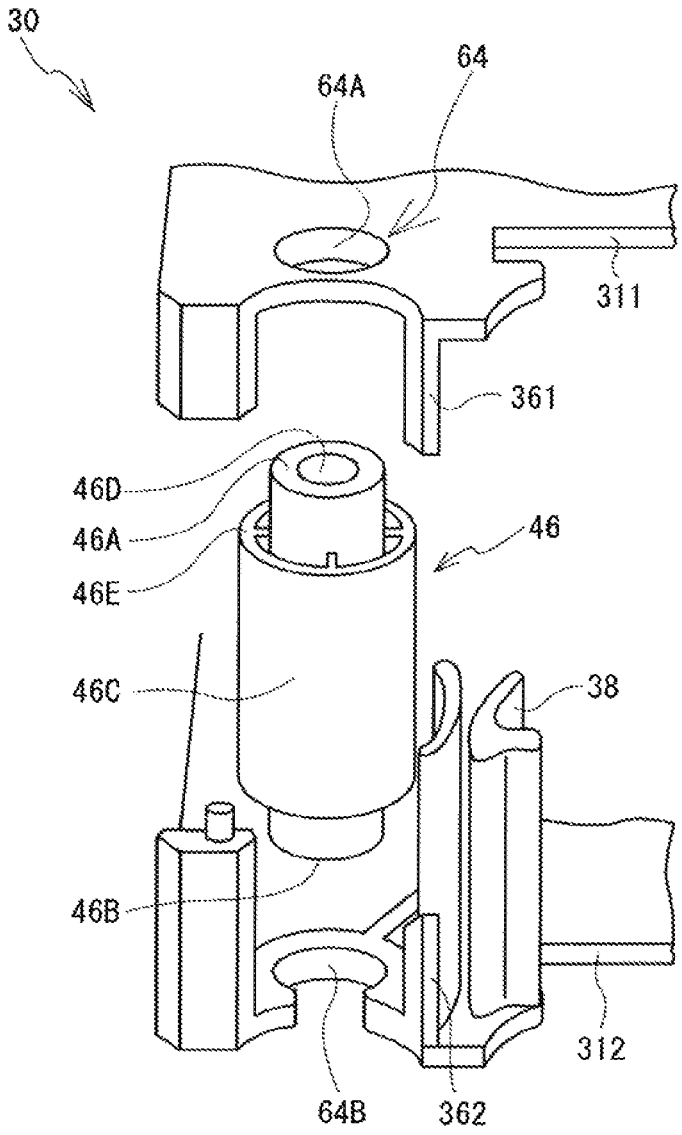
FIG. 17 is an exploded perspective view of a roller support hole 64 and a tape drive roller 46.

As shown in FIG. 17, the tape drive roller 46 is rotatably supported via the roller support hole 64 that penetrates the cassette case 31 in the up-down direction. More specifically, the roller support hole 64 is formed of an opening 64A and an opening 64B, which are through holes provided in positions facing each other in the top plate 305 and the bottom plate 306, respectively. The above-described pair of regulating members 361 and 362 are formed, respectively, in positions close to the openings 64A and 64B. The ribbon guide wall 38 is provided to the rear of the pair of regulating members 361 and 362 and adjacent to the pair of regulating members 361 and 362, the ribbon guide wall 38 being provided in a standing manner such that it extends from the top case 311 to the bottom case 312. An interval width between base ends of the pair of regulating members 361 and 362 is set to be the same as the width of the tape.

The tape drive roller 46 is a cylindrical body that has approximately the same height as the width of the cassette case 31 (namely, the length of the cassette case 31 in the up-down direction). The diameter of a main body 46E of the tape drive roller 46 is larger than the diameter of the openings 64A and 64B, and an outer peripheral surface that comes into contact with the tape etc. is a roller surface 46C. The length of the roller surface 46C in the up-down direction (namely, a tape feed width of the tape drive roller 46) is set to be the same as the width of the tape. An upper end portion 46A and a bottom end portion 46B that protrude from the main body 46E of the tape drive roller 46 in the upward and downward directions, respectively, each have a diameter that is slightly smaller than the diameter of the openings 64A and 64B. Note that a shaft hole 46D, which penetrates the main body 46E in the up-down direction, links both the end portions 46A and 46B inside the tape drive roller 46.

Inside the cassette case 31, the upper end portion 46A is fitted into the opening 64A of the top plate 305, and at the same time, the bottom end portion 46B is fitted into the opening 64B of the bottom plate 306. The main body 46E contacts the top case 311 from underneath and thus regulates the movement of the tape drive roller 46 in the upward direction. The main body 46E also contacts the bottom case 312 from above and thus regulates the movement of the tape drive roller 46 in the downward direction. In this way, the tape drive roller 46 is supported by both the end portions 46A and 46B while being rotatable around an axis line inside the cassette case 31.

A plurality of engaging ribs 46F (refer to FIG. 25) are provided on the bottom end side of an inner peripheral surface (namely, an inner wall forming the shaft hole 46D) of the tape drive roller 46. When the tape cassette 30 is inserted in the cassette housing portion 8, the above-described tape drive shaft 100 is inserted into the shaft hole 46D via the opening 64B. Then, the plurality of cam members 100A (refer to FIG. 19 and FIG. 25) that are formed around the periphery of the tape drive shaft 100 mesh with the plurality of engaging ribs 46F that are provided on the tape drive roller 46. In this way, the rotation of the tape drive shaft 100 is transmitted to the tape drive roller 46. More specifically, the tape drive roller 46 rotates in accordance with the rotation of the tape drive shaft 100. Note that the opening width of the shaft hole 46D is slightly larger than the shaft diameter of the tape drive shaft 100, in order that, when the tape drive shaft 100 is mounted, some play may exist in the tape drive roller 46 with respect to the tape drive shaft 100 in the circumferential direction.

Figure 18:
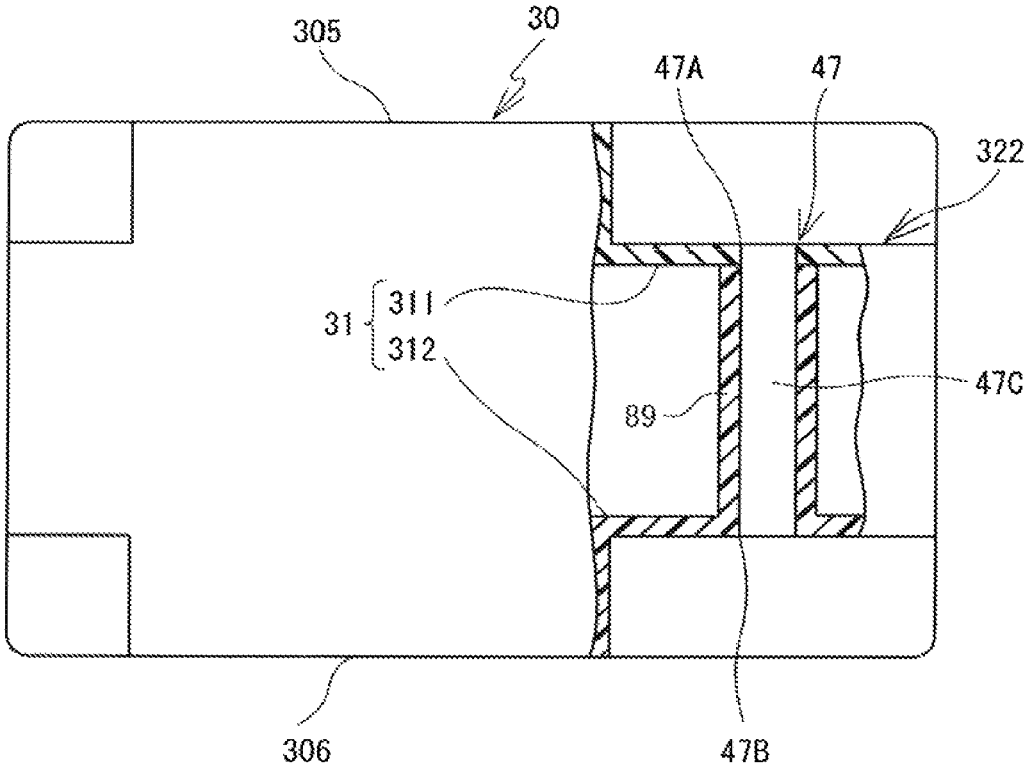
FIG. 18 is a side cross-sectional view of the tape cassette 30, centering on a guide hole 47.

As shown in FIG. 18, the guide hole 47, which penetrates the cassette case 31 in the up-down direction, is formed in the second corner portion 322 that is the rear right corner portion of the cassette case 31. More specifically, the guide hole 47 is formed of an opening 47A and an opening 47B, which are concave holes that are provided facing each other and extending from the top plate 305 and the bottom plate 306, respectively, and a shaft hole 47C that links the openings 47A and 47B. Inside the cassette case 31, a cylindrically-shaped cylindrical wall portion 89, which forms the shaft hole 47C that links the openings 47A and 47B inside, is provided such that it extends from the top plate 305 to the bottom plate 306.

As shown in FIG. 12 and FIG. 14, the second tape support hole 66 is also formed of a pair of openings 66A and 66B that are formed in positions facing each other in the top plate 305 and the bottom plate 306, respectively. The openings 66A and 66B are provided contiguously with recessed portions that are depressed inside the cassette case 31 in mutually opposing directions, respectively. The second tape spool 41 is a cylindrical body that has approximately the same height as the tape width of the printing medium. In the laminated type tape cassette 30, the film tape roll 591 is provided around the second tape spool 41 (refer to FIG. 4 and FIG. 5). When the film tape roll 591 is housed inside the cassette case 31, the recessed portions that are contiguously formed from the respective openings 66A and 66B are respectively inserted into both end openings of a shaft hole that penetrates the second tape spool in the up-down direction. In this way, the second tape spool 41 is axially supported by the second tape support hole 66 while being rotatable around an axis line inside the cassette case 31. Note that the second tape spool 41 is not provided in the receptor type and thermal type tape cassette 30 shown in FIG. 6 and FIG. 7.

Similarly, the ribbon support hole 67 is also formed of a pair of openings 67A and 67B that are formed in positions facing each other in the top plate 305 and the bottom plate 306, respectively. The openings 67A and 67B are provided contiguously with recessed portions that are depressed inside the cassette case 31 in mutually opposing directions, respectively. The ribbon spool 42 is a cylindrical body that has approximately the same height as the width of the tape, and the ink ribbon 60 is wound around the outer peripheral surface of the ribbon spool 42. When the ink ribbon 60 is housed inside the cassette case 31, the recessed portions that are contiguously formed from the respective openings 67A and 67B are respectively inserted into both end openings of a shaft hole that penetrates the ribbon spool 42 in the up-down direction. In this way, the ribbon spool 42 is axially supported by the ribbon support hole 67 while being rotatable around an axis line inside the cassette case 31. Note that the ribbon spool 42 is not provided in the thermal type tape cassette 30 shown in FIG. 7.

Here, the positional relationships among the guide hole 47, the first tape support hole 65, the take-up support hole 68 and the head insertion portion 39 that are provided in the tape cassette 30 of the present embodiment will be explained in more detail with reference to FIG. 12. Note that a broken line in FIG. 12 indicates a division line K that will be described later. The roller support hole 64, the guide hole 47, the first tape support hole 65, the take-up support hole 68 and the head insertion portion 39 that are described above are respectively formed in positions corresponding to the tape drive shaft 100, the guide shaft 120, the auxiliary shaft 110, the ribbon take-up shaft 95 and the head holder 74 of the cassette housing portion 8 in which the tape cassette 30 is inserted.

As shown in FIG. 12, the roller support hole 64 is provided in the front left portion of the tape cassette 30. The guide hole 47 is provided in the second corner portion 322 that is the rear right corner portion of the tape cassette 30. In a case where the tape cassette 30 is divided in a plan view with respect to the division line K that connects the roller support hole 64 and the guide hole 47 in a plan view, the area to the rear of the division line K is a first housing area 30C, and the area to the front of the division line K is a second housing area 30D. The first tape support hole 65 is formed at or in the vicinity of the center of gravity of the first housing area 30C (that is, at the point where the median lines for the three sides that form the first housing area 30C intersect), which forms a triangular shape in a plan view. In this case, the center of the first tape support hole 65 is positioned in the first area 331. The take-up support hole 68 is formed at or in the vicinity of the center of gravity of the second housing area 30D (that is, at the point where the median lines for the three sides that form the second housing area 30D intersect), which forms a triangular shape in a plan view. In this case, the center of the take-up support hole 68 is positioned in the first area 331. Here, in the plan view, the first tape support hole 65 and the take-up support hole 68 are positioned substantially symmetrically in relation to the division line K.

The second tape support hole 66 is formed on the division line K in the plan view. More specifically, it is positioned substantially at a midpoint between the center of the tape cassette 30 in the plan view and the guide hole 47. The ribbon support hole 67 is formed in the second housing area 30D. More specifically, it is positioned further to the front and the right of the tape cassette 30 than the take-up support hole 68.

Due to the positional relationships that are described above, the position of the center of gravity of the tape cassette 30 shown in FIG. 4 to FIG. 7 is as hereinafter described. In the laminated type tape cassette 30 shown in FIG. 4 and FIG. 5, among the double-sided adhesive tape roll 581, the film tape roll 591 and the ink ribbon roll 601, the roll with the greatest weight is the double-sided adhesive tape roll 581. In addition, as described above, inside the tape cassette 30, the first tape spool 40, around which the double-sided adhesive tape roll 581 is provided, is rotatably supported by the first tape support hole 65 (refer to FIG. 3). This indicates that the winding center of the double-sided adhesive tape 58 on the double-sided adhesive tape roll 581 is positioned within a range of the first housing area 30C (refer to FIG. 12) in the plan view, and is also positioned in the first area 331. In other words, the center of gravity or the double-sided adhesive tape roll 581 that has the greatest weight is positioned within the range of the first housing area 30C and inside the first area 331 in the plan view. As a result, the center of gravity of the tape cassette 30 as a whole is positioned within a range of the first area 331.

In addition, the winding center of the used ink ribbon 60 on the ribbon take-up spool 44 is positioned in the first area 331. In other words, the winding center of the double-sided adhesive tape 58 on the double-sided adhesive tape roll 581 and the winding center of the used ink ribbon 60 on the ribbon take-up spool 44 are positioned in the first area 331. Then, when printing is performed using the laminated type tape cassette 30, the double-sided adhesive tape 58 is consumed and the weight of the double-sided adhesive tape roll 581 decreases. On the other hand, as the used ink ribbon 60 is taken up by the ribbon take-up spool 44, the weight of the ink ribbon 60 taken up by the ribbon take-up spool 44 increases. Even in this case, as the winding center of the double-sided adhesive tape roll 581 and the winding center of the ink ribbon 60 that is taken up by the ribbon take-up spool 44 are positioned in the first area 331, the position of the center of gravity of the tape cassette 30 remains stable within the range of the first area 331.

In the case of the receptor type tape cassette 30 shown in FIG. 6, of the print tape roll 571 and the ink ribbon roll 601, the roll with the greatest weight is the print tape roll 571. In addition, as described above, inside the tape cassette 30, the first tape spool 40, around which the print tape roll 571 is provided, is rotatably supported by the first tape support hole 65. This indicates that the winding center of the print tape 57 on the print tape roll 571 is positioned within the range of the first housing area 30C (refer to FIG. 12) in the plan view, and is also positioned in the first area 331. In other words, the center of gravity of the print tape roll 571 that has the greatest weight is positioned within the range of the first housing area 30C and inside the first area 331 in the plan view. As a result, the center of gravity of the tape cassette 30 as a whole is positioned within the range of the first area 331.

In addition, the winding center of the used ink ribbon 60 on the ribbon take-up spool is positioned in the first area 331. The winding center of the print tape 57 on the print tape roll 571 and the winding center of the used ink ribbon 60 on the ribbon take-up spool are both positioned in the first area 331. Then, when printing is performed using the receptor type tape cassette 30, the print tape 57 is consumed and the weight of the print tape roll 571 decreases. On the other hand, the weight of the ink ribbon 60 taken up by the ribbon take-up spool 44 increases. Even in this case, as the winding center of the print tape roll 571 and the winding center of the ink ribbon 60 that is taken up by the ribbon take-up spool 44 are positioned in the first area 331, the position of the center of gravity of the tape cassette 30 remains stable within the range of the first area 331.

In the case of the thermal type tape cassette 30 shown in FIG. 7, as described above, inside the tape cassette 30, the first tape spool 40, around which the heat-sensitive paper tape roll 551 is provided, is rotatably supported by the first tape support hole 65. This indicates that the winding center of the heat-sensitive paper tape 55 on the heat-sensitive paper tape roll 551 is positioned within the range of the first housing area 30C (refer to FIG. 12) in the plan view, and is also positioned in the first area 331. In other words, the center of gravity of the heat-sensitive paper tape roll 551 is positioned within the range of the first housing area 30C and inside the first area 331 in the plan view. As a result, the center of gravity of the tape cassette 30 as a whole is positioned within the range of the first area 331.

With the tape printer 1 and the tape cassette 30 explained above, when the tape cassette 30 is inserted in the cassette housing portion 8, the three guide shafts (the tape drive shaft 100, the guide shaft 120 and the auxiliary shaft 110) and the head holder 74, which are provided in a standing manner in the cassette housing portion 8, are respectively guided by the three guide holes (the roller support hole 64, the guide hole 47 and the first tape support hole 65) and the head insertion portion 39 that are provided in the tape cassette 30. As a result, the tape cassette 30 is inserted in the cassette housing portion 8 in the correct position.

Figure 19:
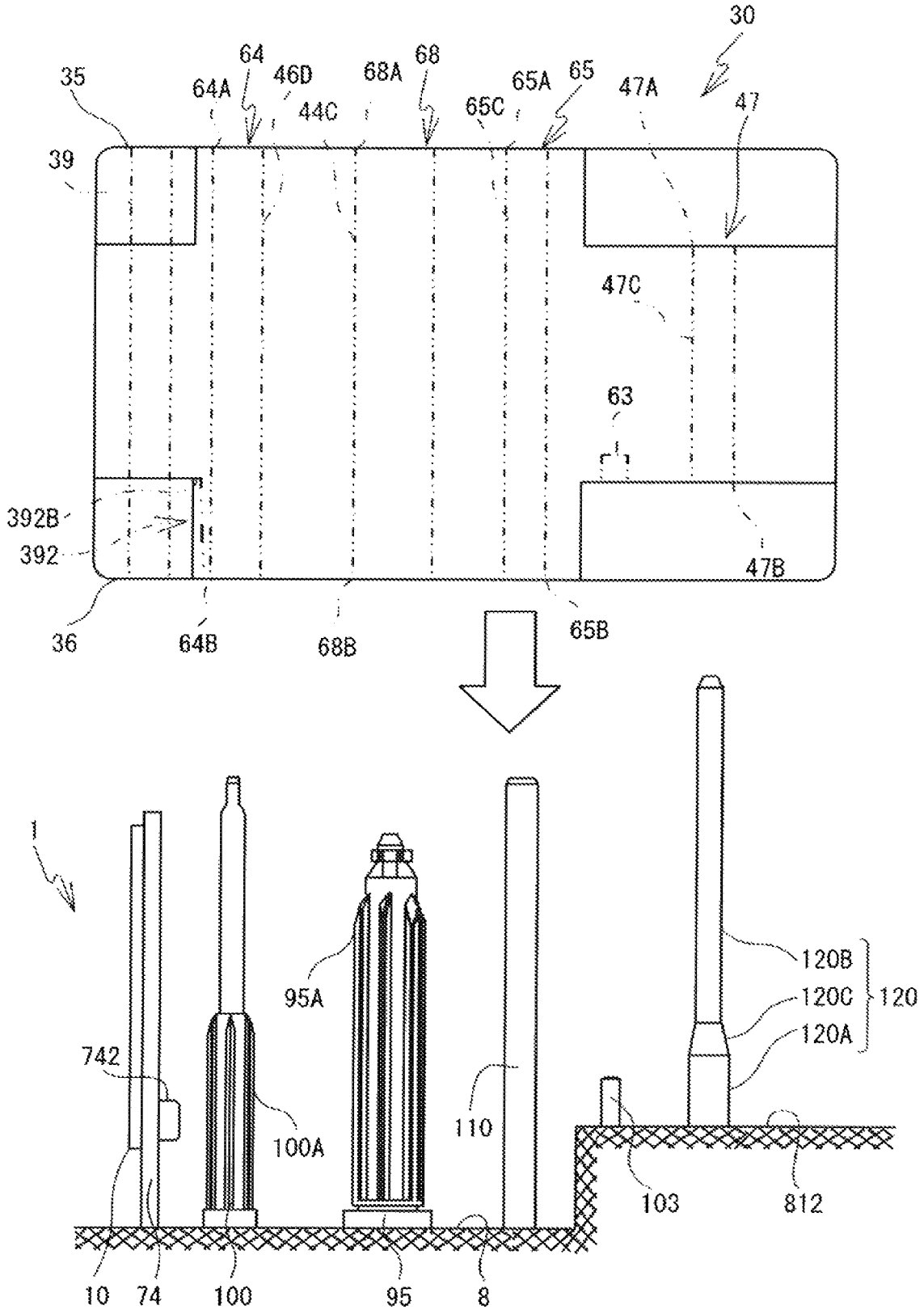
FIG. 19 is a right side view showing an insertion process to insert the tape cassette 30 into the cassette housing portion 8.
Figure 20:
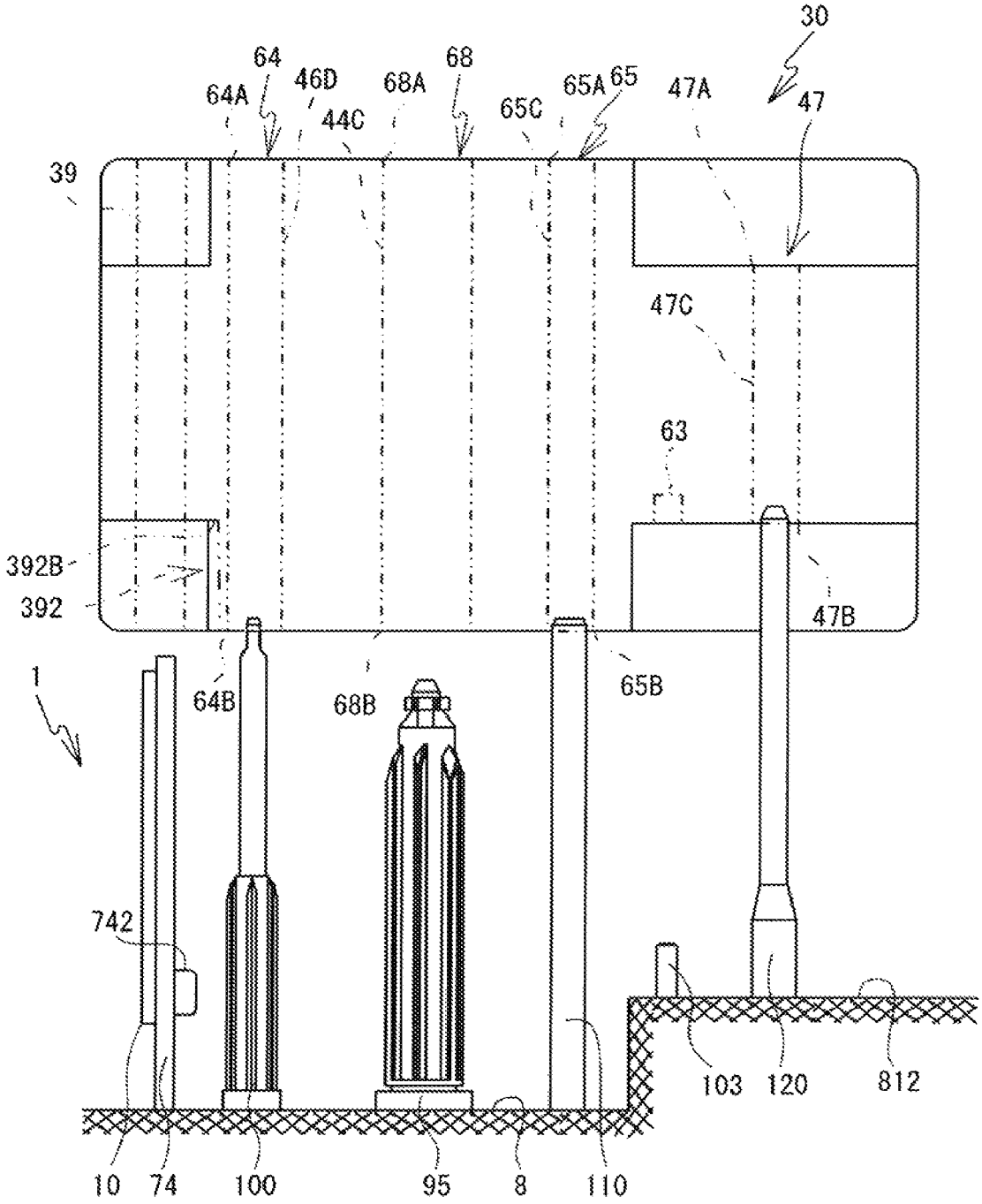
FIG. 20 is a right side view showing the insertion process to insert the tape cassette 30 into the cassette housing portion 8.
Figure 21:
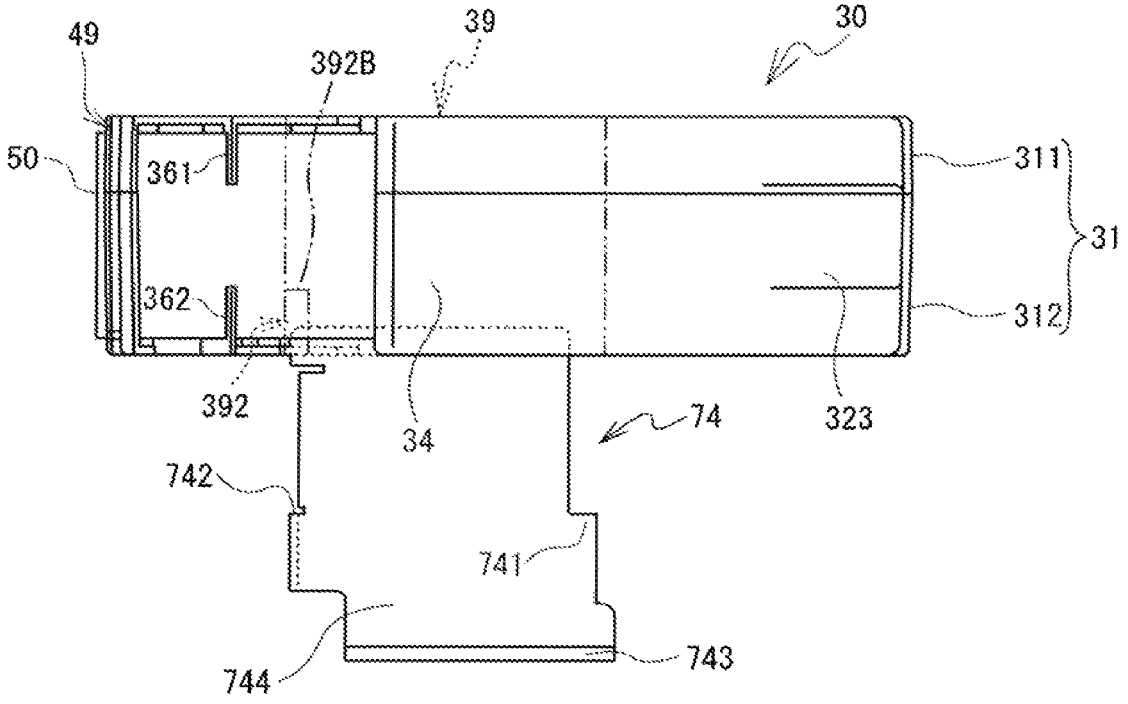
FIG. 21 is a front view showing a positional relationship between a head insertion portion 39 and the head holder 74, in the insertion process to insert the tape cassette 30 into the cassette housing portion 8.
Figure 22:
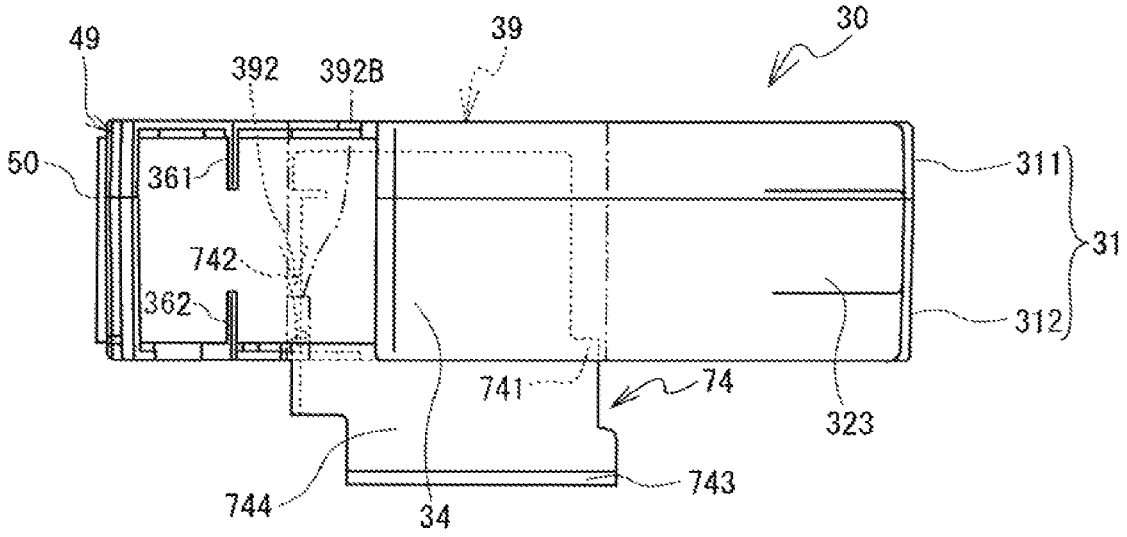
FIG. 22 is a front view showing a positional relationship between the head insertion portion 39 and the head holder 74, in the insertion process to insert the tape cassette 30 into the cassette housing portion 8.
Figure 23:
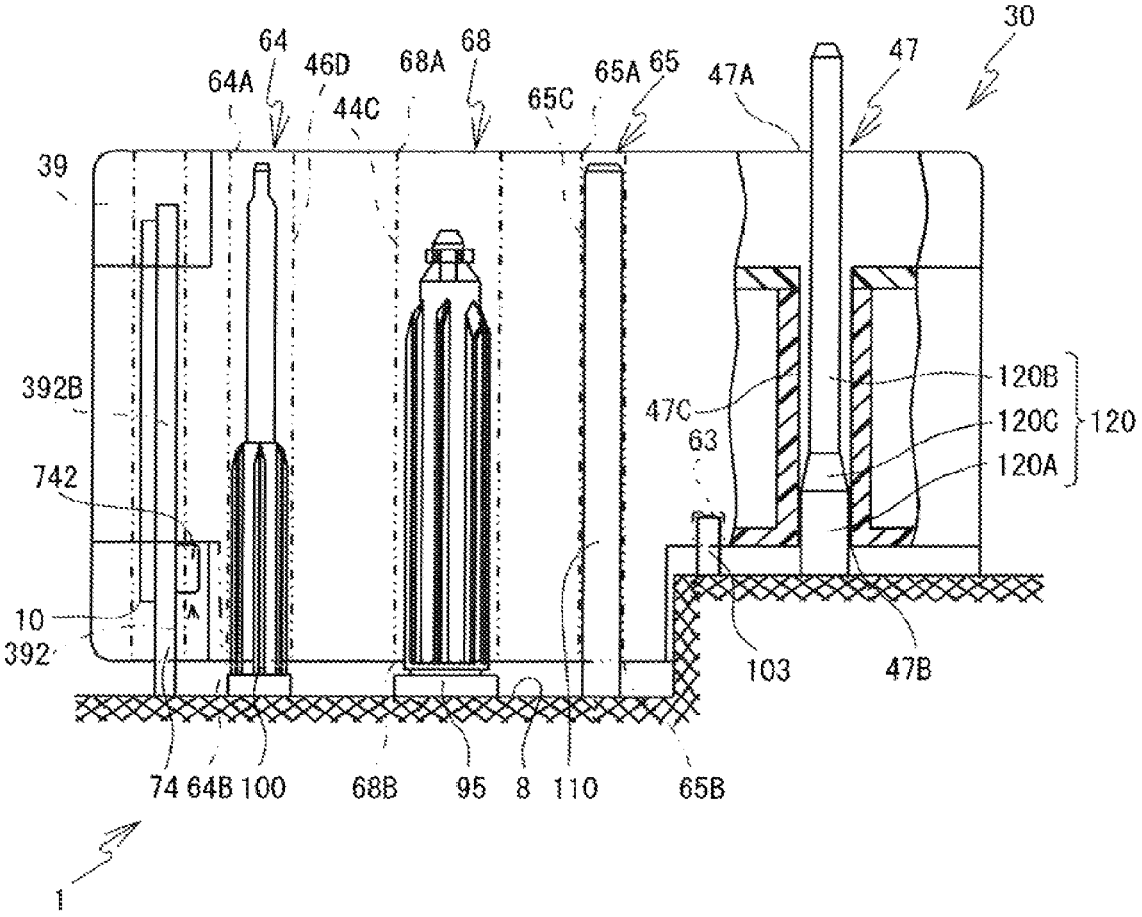
FIG. 23 is a right side view showing a state in which the tape cassette 30 is inserted in the cassette housing portion 8.
Figure 24:
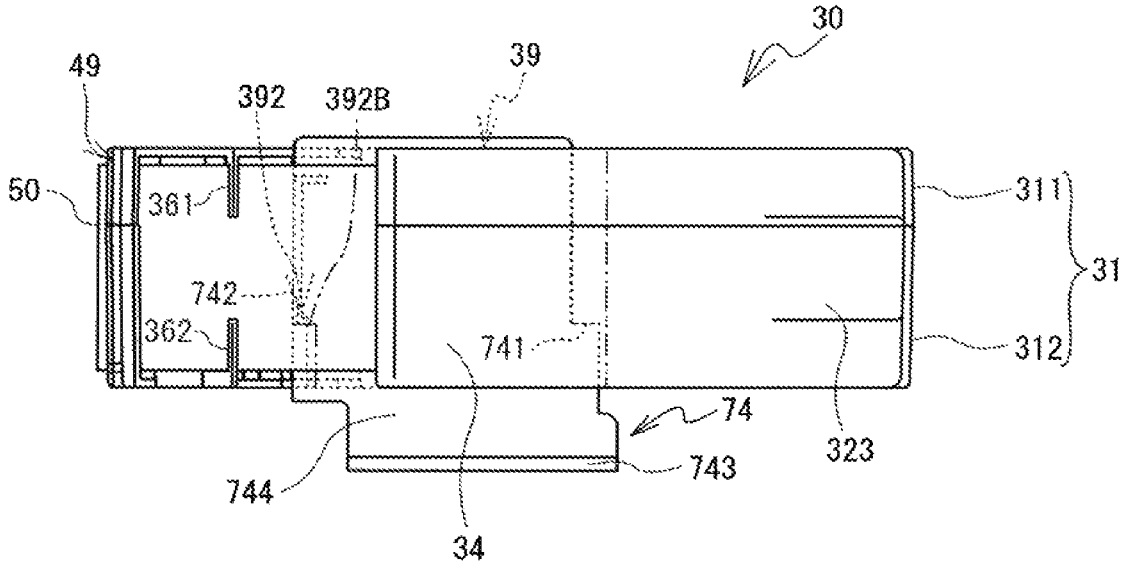
FIG. 24 is a front view showing a positional relationship between the head insertion portion 39 and the head holder 74 in the state in which the tape cassette 30 is inserted in the cassette housing portion 8.

Here, states of insertion and removal of the tape cassette 30 with respect to the cassette housing portion 8 in the present embodiment will be explained in more detail with reference to FIG. 19 to FIG. 26. The right side surface of the tape cassette 30 is shown in FIG. 19, FIG. 20 and FIG. 23, and for ease of explanation, holes etc. relating to the insertion and removal of the tape cassette 30 are indicated by virtual lines (two-dotted chain lines). Furthermore, a schematic cross-section of the cassette housing portion 8 as seen from the right side is shown, and for ease of explanation, only the shaft portions relating to the insertion and removal of the tape cassette 30 are shown. It should be noted that, in FIG. 23, the guide hole 47 and its vicinity are shown as a cross-sectional view from the right side. In addition, FIG. 21, FIG. 22 and FIG. 24 show a front view of the tape cassette 30, and for ease of explanation, the left and right end portions of the head insertion portion 39 of the tape cassette 30 are shown as virtual lines (two-dotted chain lines). Further, in FIG. 21, FIG. 22 and FIG. 24, depiction of the thermal head 10 is omitted.

First, the height relationships of the members provided in a standing manner in the cassette housing portion 8 will be explained. Among the head holder 74, the tape drive shaft 100, the ribbon take-up shaft 95, the auxiliary shaft 110 and the guide shaft 120, the shaft lengths of the three guide shafts (the tape drive shaft 100, the auxiliary shaft 110 and the guide shaft 120) are substantially the same. Additionally, each of the shaft lengths of the tape drive shaft 100, the auxiliary shaft 110 and the guide shaft 120 is longer than the shaft length of the ribbon take-up shaft 95 and longer than the vertical size of the head holder 74. For that reason, among the head holder 74, the tape drive shaft 100, the ribbon take-up shaft 95 and the auxiliary shaft 110, height positions of the upper ends of the tape drive shaft 100 and the auxiliary shaft 110 are the highest, the height position of the upper end of the head holder 74 is next highest, and the height position of the upper end of the ribbon take-up shaft 95 is lowest. Note that the height position of the upper end of the ribbon take-up shaft 95 is approximately the same as the height position of the upper end of the thermal head 10 that is affixed to the head holder 74.

As described above, the guide shaft 120 is provided in a standing manner on the corner support portion 812. Also, the height position of the upper end of the guide shaft 120 is higher than the upper end of any of the head holder 74, the tape drive shaft 100, the ribbon take-up shaft 95 and the auxiliary shaft 110.

As shown in FIG. 19, when a user inserts the tape cassette 30 in the cassette housing portion 8, the user causes the roller support hole 64, the first tape support hole 65 and the guide hole 47 to be in positions that, in the plan view, substantially match the relative positions of the tape drive shalt 100, the auxiliary shaft 110 and the guide shaft 120, respectively, and vertically inserts the tape cassette 30 while maintaining the top plate 305 and the bottom plate 306 substantially horizontally. If the tape cassette 30 is moved downward toward the cassette housing portion 8, the upper ends of the tape drive shaft 100, the auxiliary shaft 110 and the guide shaft 120 shown in FIG. 20 respectively enter, at substantially the same time, the openings 64B, 65B and 47B that are provided in the bottom plate 306 of the tape cassette 30. On the other hand, the upper ends of the head holder 74 and the ribbon take-up shaft 95 are in a state in which they are respectively positioned below the bottom plate 306 and they do not enter inside the tape cassette 30.

When the tape cassette 30 is moved further downward from a state that is shown in FIG. 20, the tape drive shaft 100, the auxiliary shaft 110, and the guide shaft 120 are respectively inserted from underneath into the shaft holes 46D, 65C and 47C via the openings 64B, 65B and 47B. Inside the shaft holes 46D, 65C and 47C, the movement of the tape drive shaft 100, the auxiliary shaft 110 and the guide shaft 120 is restrained in the circumferential direction by the inner walls of the shaft holes 46D, 65C and 47C into which they are respectively inserted, while being in a state in which they can slide along the standing directions (namely, in the up-down direction). In other words, the tape cassette 30 may move downward wider the action of its own weight, while being guided along the standing directions of the tape drive shaft 100, the auxiliary shaft 110 and the guide shaft 120, which are respectively inserted into the shaft holes 46D, 65C and 47C.

Note that the upper end edges of the tape drive shaft 100, the auxiliary shaft 110 and the guide shaft 120 have a tapered shape in which the shaft diameter becomes smaller toward the upper end. Thus even if there is a slight displacement with the relative positions of the roller support hole 64, the first tape support hole 65 and the guide hole 47 in the plan view, the tape drive shaft 100, the auxiliary shaft 110 and the guide shaft 120 can be correctly and smoothly inserted. Further, the shaft diameter of the tape drive shaft 100 is slightly smaller than the opening width of the tape drive roller 46 (the shaft hole 46D) and therefore, even if the horizontal position of the tape drive roller 46 changes slightly inside the roller support hole 64 due to vibration or tilting etc., the tape drive shaft 100 can be smoothly inserted.

In addition, as described above, the opening width of the guide hole 47 is larger than the shaft diameter of the leading end portion (the above-described small diameter shaft portion 120B) of the guide shaft 120, and in particular, the opening width from the front left to the rear right is larger than the opening width from the front right toward the rear left. Therefore, when inserting the tape cassette 30, even if the position of the guide hole 47 relative to the position of the guide shaft 120 in the plan view is slightly displaced, the guide shaft 120 can be inserted into the guide hole 47. Thus, as it is not necessary to perform accurate positioning of the hole portions of the tape cassette 30 with respect to all of the corresponding three guide shafts provided in the cassette housing portion 8, a burden on the user when inserting the tape cassette 30 may be reduced. Further, at the time of manufacture of the tape cassette 30, in order to make the dimensional widths of the roller support hole 64 and the guide hole 47 completely match the dimensional widths of the tape drive shaft 100 and the guide shaft 120, respectively, a high degree of dimensional accuracy is required of the operator. On this point, by forming some play in the guide hole 47, a slight amount of error in the dimensional accuracy in forming the guide hole 47 is allowed, and the burden at the time of manufacture of the tape cassette 30 may also be reduced.

Furthermore, the ribbon take-up shaft 95 is inserted from underneath into the shaft hole 44C via the opening 68B. The opening width of the ribbon take-up spool 44 (the shaft hole 44C) is larger than the shaft diameter of the ribbon take-up shaft 95, and the ribbon take-up shaft 95 is movably inserted inside the ribbon take-up spool 44 such that it can be displaced in the circumferential direction.

On the other hand, as the tape cassette 30 is guided downward from the position shown in FIG. 20, the head holder 74 is inserted into the head insertion portion 39 from underneath, as shown in FIG. 21. A distance in the left-right direction of the upper portion of the head holder 74 is smaller than the first distance A1 (refer to FIG. 12 and FIG. 13) that is the distance in the left-right direction of the head insertion portion 39. Therefore, even if the position of the tape cassette 30 is displaced relative to the position of the head holder 74 in the plan view, the head holder 74 can be inserted smoothly into the head insertion portion 39 without the left and right end portions becoming caught up.

When the tape cassette 30 is moved further downward, the stepped portion 741 provided on the head holder 74 is inserted into the head insertion portion 39, as shown in FIG. 22. In this way, the end portions of the head insertion portion 39 in the left-right direction are guided by the head holder 74 including the stepped portion 741, and the head insertion portion 39 is led to the correct position.

When the tape cassette 30 is moved downward along the head holder 74, the tape drive shaft 100, the auxiliary shaft 110 and the guide shaft 120, the positioning pin 103 provided in a standing manner on the corner support portion 812 comes into contact with a top wall inside the pin hole 63, as shown in FIG. 23. At the same time, although not shown in FIG. 23, the positioning pin 102 provided in a standing manner on the corner support portion 812 is inserted into the pin hole 62 and the upper end of the positioning pin 102 comes into contact with a top wall inside the pin hole 62. Further, as shown in FIG. 23 and FIG. 24, the cassette support portion 742 comes into contact with the lower side flat surface portion 392B and positioning is performed. More specifically, the height position of the tape cassette 30 that is inserted in the cassette housing portion 8 is regulated as a height position in which the tape cassette 30 is supported by the positioning pins 102 and 103 and by the cassette support portion 742 and the like.

Furthermore, the base end side (the above-described large diameter shaft portion 120A) of the guide shaft 120 is fitted into the guide hole 47 (the shaft hole 47C) while being guided along the tapered portion 120C. As described above, the shaft diameter of the large diameter shaft portion 120A is substantially the same as the opening width of the guide hole 47, and therefore, the large diameter shaft portion 120A is tightly engaged with the guide hole 47 in the front-rear direction, and displacement of the guide shaft 120 in the circumferential direction is thus regulated. In addition, the positioning pins 102 and 103 are engaged inside of the pin holes 62 and 63, respectively, and displacement of the positioning pins 102 and 103 in the circumferential direction is thus regulated. Specifically, a horizontal position of the tape cassette 30 that is inserted in the cassette housing portion 8 is regulated as a horizontal position in which the tape cassette 30 is engaged by the guide shaft 120 and the positioning pins 102 and 103.

Figure 25:
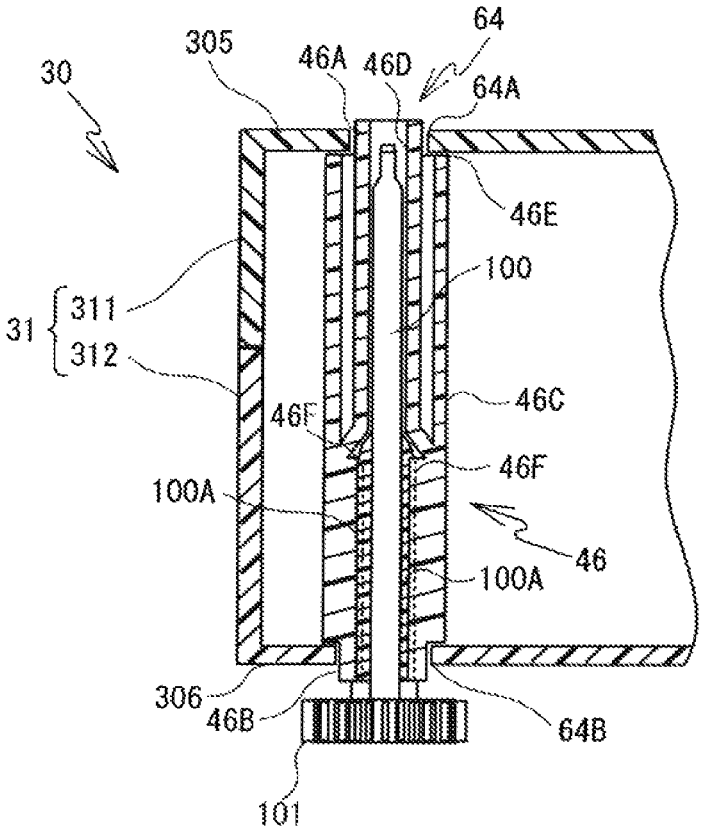
FIG. 25 is a front cross-sectional view showing a state in which a tape drive shaft 100 is inserted in the tape drive roller 46.
Figure 26:
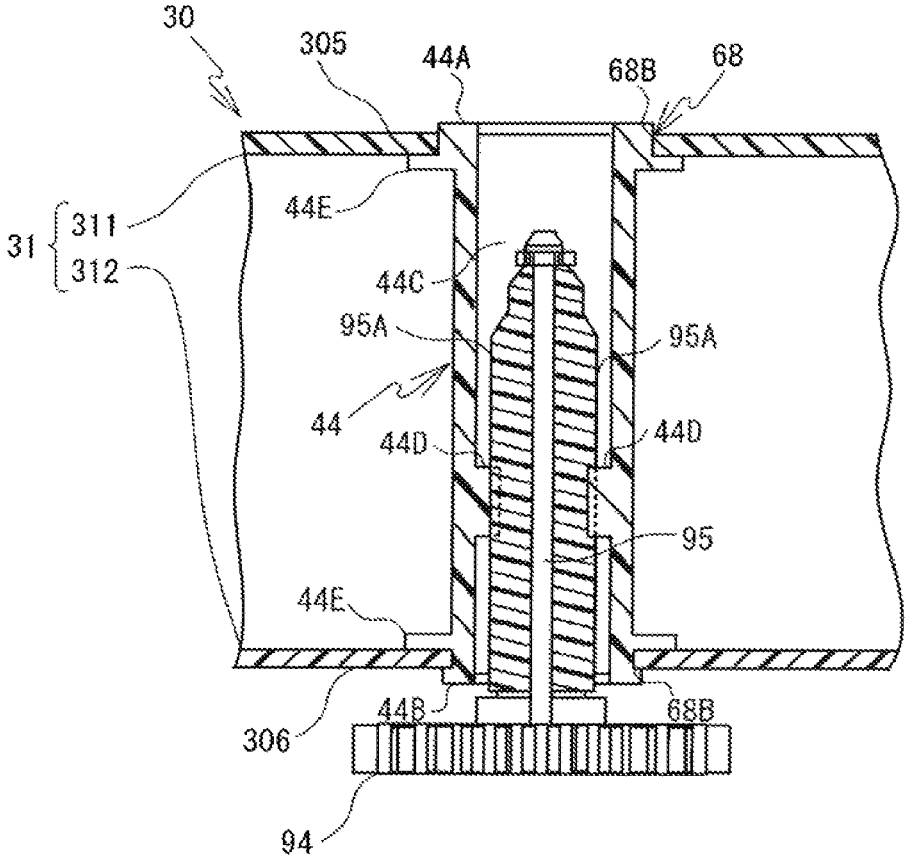
FIG. 26 is a front cross-sectional view showing a state in which a ribbon take-up shaft 95 is inserted in the ribbon take-up spool 44.

In this way, in the present embodiment, the tape cassette 30 is guided to the correct position in the cassette housing portion 8 by the three guide shafts (the tape drive shaft 100, the auxiliary shaft 110 and the guide shaft 120) and by the head holder 74. Then, the tape cassette 30 is positioned in the correct horizontal position by the guide shaft 120 and the positioning pin 102, and is also positioned in the correct height position by the cassette support portion 742 and the positioning pins 102 and 103 and so on. Thus, in a state in which the tape cassette 30 is positioned in the correct position, the cam members 100A that are provided on the base end side of the tape drive shaft 100 are correctly meshed with the engaging ribs 46F that are provided on the tape drive roller 46, as shown in FIG. 25. Further, the cam members 95A that are provided on the ribbon take-up shaft 95 are correctly meshed with the engaging ribs 44D that are provided on the ribbon take-up spool 44, as shown in FIG. 26. In addition, the thermal head 10 that is provided on the head holder 74 is disposed in the correct print position of the head insertion portion 39. Namely, the tape printer 1 is in a state in which it can perform printing correctly on the tape.

Note that, when the tape cassette 30 is removed from the cassette housing portion 8, the user may pull the tape cassette 30 upward from the cassette housing portion 8 while pinching both the left and right side walls of the tape cassette 30 with his or her fingers, for example. Also at that time, the tape cassette 30 can be guided in the up-down direction by the head holder 74 and the three guide shafts (the tape drive shaft 100, the auxiliary shaft 110 and the guide shaft 120). Thus, in a process of removing the tape cassette 30 from the cassette housing portion 8, it is possible to inhibit a risk of the tape cassette 30 tilting and becoming caught up on the inner wall etc. of the cassette housing portion 8.

The tape cassette 30 of the present embodiment may be inserted into and removed from the cassette housing portion 8 in the manner described above. In a known tape cassette, the first distance A1, which is the length of the head insertion portion 39 in the left-right direction, is equal to or less than the second distance A2, which is the length from the right end portion of the head insertion portion 39 to the right end portion of the tape cassette 30. In contrast to this, in the present embodiment, the first distance A1 is larger than the second distance A2, as shown in FIG. 12 and FIG. 13. In this case, the center of gravity of the tape cassette 30 can be easily positioned in the first area 331. In the present embodiment, as described above, the center of gravity of the laminated type, the receptor type and the thermal type tape cassette 30 shown in FIG. 4 to FIG. 7 is positioned in the first area 331. More specifically, the center of the head insertion portion 39 in the left-right direction is close to the center of gravity of the tape cassette 30 in the left-right direction. In other words, the weight distribution is favorable. Thus, when the tape cassette 30 is inserted into the cassette housing portion 8, when it is guided by the head holder 74, there may be little risk of the tape cassette 30 tilting in the left or right directions. As a result, the tape cassette 30 can be correctly disposed in the cassette housing portion 8. Thus, the tape etc. can be fed correctly and printing accuracy can be improved.

Furthermore, the tape cassette 30 may be packaged for the purpose of transportation and sale etc. When a plate-shaped member (hereinafter referred to as a packaging support member), which is inserted into the head insertion portion 39 of the tape cassette 30 and which supports the tape cassette 30, is provided in a container for packaging, the packaging support member can correctly support the tape cassette 30 by being inserted into the head insertion portion 39. When the tape cassette 30 of the present embodiment is mounted in the packaging container, the head insertion portion 39 can be correctly led to the packaging support member and the tape cassette 30 can be correctly mounted in the packaging container. This is because the center of the head insertion portion 39 in the left-right direction is close to the center of gravity of the tape cassette 30 in the left-right direction and there is a favorable weight distribution. As a result, there may be little risk of tilting of the tape cassette 30. It is thus possible to enhance operation efficiency of an operator performing the packaging.

In addition, in the known tape cassette, the first distance A1 is equal to or less than the second distance A2, and the right end portion of the head insertion portion 39 is positioned further to the left, in the left-right direction, than the center of the take-up support hole 68. In contrast to this, in the present embodiment, the first distance A1 is larger than the second distance A2, and the right end portion of the head insertion portion 39 is further to the right in comparison to the known tape cassette. As a result, the right end portion of the head insertion portion 39 is positioned further to the right, in the left-right direction, than the center of the take-up support hole 68. In other words, the center of the first tape support hole 65 and the center of the take-up support hole 68 are positioned in the first area 331.

For that reason, in the laminated type tape cassette 30 (refer to FIG. 4 and FIG. 5), the winding center of the double-sided adhesive tape 58 on the double-sided adhesive tape roll 581 and the winding center of the used ink ribbon 60 on the ribbon take-up spool 44 are positioned in the first area 331. Further, in the receptor type tape cassette 30 (refer to FIG. 6), the winding center of the print tape 57 on the print tape roll 571 and the winding center of the used ink ribbon 60 on the ribbon take-up spool 44 are positioned in the first area 331. As a result, as described above, in the laminated type and the receptor type tape cassette 30, even when the tape cassette 30 is used and the tape etc. is consumed, the position of the center of gravity of the tape cassette 30 remains stable within the range of the first area 331. It is thus possible to maintain the favorable weight distribution. As the favorable weight distribution is maintained, when the tape cassette 30 is inserted into the cassette housing portion 8 and is guide by the head holder 74, there may be little risk that the tape cassette 30 will tilt in the left or right directions. Thus, the tape cassette 30 can be correctly disposed in the cassette housing portion 8. As a result, the tape etc. can be correctly fed and the printing accuracy can be improved.

In addition, the tape cassette 30 is provided with the first tape support hole 65 and the take-up support hole 68. Also, the auxiliary shaft 110 and the ribbon take-up shaft 95 are provided in a standing manner in the tape printer 1. When the tape cassette 30 is inserted into or removed from the cassette housing portion 8, the auxiliary shaft 110 and the ribbon take-up shaft 95 are inserted and removed via the first tape support hole 65 and the take-up support hole 68. The tape cassette 30 can be correctly guided in this manner.

Furthermore, the tape cassette 30 is provided with the roller support hole 64 and the guide hole 47. Also, the tape drive shaft 100 and the guide shaft 120 are provided in a standing manner in the tape printer 1. When the tape cassette 30 is inserted into or removed from the cassette housing portion 8, the tape drive shaft 100 and the guide shaft 120 are inserted and removed via the roller support hole 64 and the guide hole 47. The tape cassette 30 can be correctly guided in this manner.

In addition, as described above and as shown in FIG. 4 to FIG. 6, in the receptor type and the laminated type tape cassette 30, the feed direction of the ink ribbon 60 is changed by the ink ribbon 60 coming into contact with the wall that forms the right end portion of the head insertion portion 39. Further, as the right end portion of the head insertion portion 39 is moved further to the right in comparison to the known tape cassette, a distance between the wall that forms the right end portion of the head insertion portion 39 and the ink ribbon roll 601 is closer than in the known tape cassette. In this case, the feed path of the ink ribbon 60 between the wall that forms the right end portion of the head insertion portion 39 and the ink ribbon roll 601 is closer to the front-rear direction of the tape cassette 30, in comparison to the known tape cassette. In this way, an amount of change in the angle of the feed path of the ink ribbon 60 that changes by coming into contact with the wall that forms the right end portion of the head insertion portion 39 is larger than in the case of the known tape cassette. For that reason, when the ink ribbon 60 is fed, a force of contact between the ink ribbon 60 and the wall of the right end portion of the head insertion portion 39 may be stronger. Thus, when the ink ribbon 60 is fed, the tension that is applied to the ink ribbon 60 may be larger. In this way, it is possible to reduce the risk of vibration etc. occurring in the ink ribbon 60. Thus the feed accuracy of the ink ribbon 60 can be improved and printing accuracy can also be improved.

Further, in the present embodiment, among the first distance A1, the second distance A2 and the third distance A3, the first distance A1 is the longest. As a result, the center of gravity of the tape cassette 30 is easily positioned in the first area 331. Therefore, the center of the head insertion portion 39 in the left-right direction is close to the position of the center of gravity of the tape cassette 30 in the left-right direction. For that reason, the weight distribution is favorable, and it is possible to reduce a risk that the tape cassette 30 tilts when the tape cassette 30 is housed in the tape printer 1 or in a packaging box, for example.

It should be noted that the tape cassette 30 and the tape printer 1 according to the present disclosure are not limited to the above-described embodiment, and various modifications may of course be applied without departing from the gist of the present disclosure.

For example, in the present embodiment, the tape cassette 30 is provided with the head insertion portion 39, the first tape support hole 65, the take-up support hole 68, the roller support hole 64 and the guide hole 47 and each of these members is used for guiding the tape cassette 30 when the tape cassette 30 is inserted or removed. However, the head insertion portion 39 only may be used for guiding the tape cassette 30. In addition, at least one from among the first tape support hole 65, the take-up support hole 68, the roller support hole 64 and the guide hole 47 may be used for guiding the tape cassette 30.

Further, in the present embodiment, the tape printer 1 is provided with the head holder 74, the auxiliary shaft 110, the ribbon take-up shaft 95, the tape drive shaft 100 and the guide shaft 120. The tape cassette 30 is provided with the head insertion portion 39, the first tape support hole 65, the take-up support hole 68, the roller support hole 64 and the guide hole 47.

However, for example, in the laminated type and the receptor type tape cassette 30 (refer to FIG. 4 to FIG. 6), only the head insertion portion 39, the roller support hole 64 and the take-up support hole 68 may be provided. In addition, at least one of the first tape support hole 65 and the guide hole 47 may be provided. Further, the tape printer 1 may be provided with only the tape drive shaft 100, the ribbon take-up shaft 95 and the head holder 74.

Furthermore, for example, in the thermal type tape cassette 30 (refer to FIG. 7), only the head insertion portion 39 and the roller support hole 64 may be provided. In addition, at least one from among the first tape support hole 65, the take-up support hole 68 and the guide hole 47 may be provided.

It should be noted that, at the time of performing printing, the ribbon take-up spool 44 is also driven to rotate via the ribbon take-up shaft 95. However, the ribbon spool 42 is not housed in the thermal type tape cassette 30 shown in FIG. 7. For that reason, pulling of the unused ink ribbon 60 and taking up of the used ink ribbon 60 by the ribbon take-up spool 44 is not performed. In other words, even when the thermal type tape cassette 30 is used in the tape printer 1 that is provided with the ribbon take-up shaft 95, the rotation driving of the ribbon take-up shaft 95 does not have an impact on the operation of printing on the heat-sensitive paper tape 55, and printing can be performed correctly. Therefore, in the thermal type tape cassette 30, the ribbon take-up shaft 95 may be caused to rotate idly inside the take-up support hole 68, without providing the ribbon take-up spool 44. Furthermore, if the tape printer 1 is a dedicated machine in which only the thermal type tape cassette 30 is used, the ribbon take-up shaft 95 that causes the ribbon take-up spool 44 to rotate need not necessarily be provided. As a result, the tape cassette 30 need not necessarily be provided with the take-up support hole 68.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape cassette comprising;

a generally rectangular housing having a top wall and a bottom wall, the generally rectangular housing defining first, second, third, and fourth corner portions, wherein the fourth and second corner portions are disposed diagonally at opposite ends of the bottom wall;

a first hole formed in the fourth corner portion, the first hole extending from the bottom wall toward the top wall;

a roller provided in the fourth corner portion;

a second hole formed in the second corner portion, the second hole extending from the bottom wall toward the top wall;

a double-sided adhesive tape wound around a first tape spool, the first tape spool being positioned in a first area, the first area being at one side with respect to a first straight line connecting the first hole and the second hole;

a film tape wound around a second tape spool, the second tape spool being on the first straight line;

an ink ribbon wound around a ribbon spool, the ribbon spool being positioned in a second area, the second area being at the other side with respect to the first straight line;

a ribbon winding spool configured to wind the ink ribbon, the ribbon winding spool being positioned in the second area; and a tape containment portion positioned around the film tape, the tape containment portion extending from the bottom wall toward the top wall, a part of the tape containment portion being a part of an edge defining the second hole, the tape containment portion comprising an arc-like wall, the arc-like wall accommodating the film tape inside the arc-like wall, the second hole being positioned outside the arc-like wall.

2. The tape cassette according to claim 1, further comprising a third hole formed in the fourth corner portion, the third hole extending from the bottom wall toward the top wall, wherein a part of the film tape adhered by a part of the double-sided adhesive tape are positioned at one side with respect to the roller, the third hole is positioned at the opposite side of the one side with respect to the roller, and the second hole is an elongated hole having a length greater than a width, the length extending along a second straight line connecting the second hole and the third hole.

3. The tape cassette according to claim 2, wherein the edge defining the elongated hole includes a first edge, a second edge and a third edge, the first edge and the second edge extending along the second straight line, the width of the elongated hole being a width between the first edge and the second edge, the third edge connecting one end of the first edge with one end of the second edge.

4. The tape cassette according to claim 3, wherein the third edge is the part of the tape containment portion.

5. The tape cassette according to claim 4, wherein the third edge convexly protrudes toward the third hole.

6. The tape cassette according to claim 3, wherein the elongated hole is a closed hole defined by the first edge, the second edge, the third edge and a fourth edge, the fourth edge being opposite to the third edge and connecting the other end of the first edge with the other end of the second edge, the fourth edge convexly protruding away from the third hole.

7. The tape cassette according to claim 2, wherein the third hole is formed as a first indentation, the first indentation being provided at one side with respect to the roller in a first direction perpendicular to the part of the film tape adhered by the part of the double-sided adhesive tape, the part of the film tape adhered by the part of the double-sided adhesive tape being positioned at the other side with respect to the roller in the first direction, the first indentation having a first bottom opening, a first extending wall and a first top ceiling, the first bottom opening being formed in the fourth corner portion and in the bottom wall, the first top ceiling being provided between the bottom wall and the top wall in a second direction perpendicular to the bottom wall, the first top ceiling being generally parallel to the bottom wall, the first extending wall extending from the first bottom opening to the first top ceiling.

8. The tape cassette according to claim 7, further comprising a fourth hole, the fourth hole extending from the bottom wall toward the top wall, the fourth hole being positioned at the same side with the first hole with respect to the second hole in the first direction.

9. The tape cassette according to claim 8, wherein the fourth hole is formed as a second indentation, the second indentation having a second bottom opening, a second extending wall and a second top ceiling, the second bottom opening being formed in the bottom wall, the second top ceiling being provided between the bottom wall and the top wall in the second direction, the second top ceiling being generally parallel to the bottom wall, the second extending wall extending from the second bottom opening to the second top ceiling.

10. The tape cassette according to claim 2, wherein the third hole is configured to accommodate a positioning pin of a printer.

11. The tape cassette according to claim 1, wherein the second hole is a through-hole extending from the bottom wall to the top wall.

12. The tape cassette according to claim 1, wherein the first hole is configured to accommodate a guide shaft of a printer, and the second hole is configured to accommodate another guide shaft of the printer.

13. The tape cassette according to claim 1, wherein the ribbon winding spool is configured to accommodate a ribbon take-up shaft of a printer.

14. The tape cassette according to claim 1, wherein the bottom wall comprises a first bottom surface, a second bottom surface and a bottom connection wall, the second bottom surface being closer to the top wall than the first bottom surface, the bottom connection wall connecting the first bottom surface and the second bottom surface, the second hole having an opening in the second bottom surface.

15. The tape cassette according to claim 14, wherein a part of the bottom connection wall defines a part of the edge defining the second hole.

16. The tape cassette according to claim 1, wherein the top wall comprises a first top surface, a second top surface and a top connection wall, the second top surface being closer to the bottom wall than the first top surface, the top connection wall connecting the first top surface and the second top surface, the second hole having an opening in the second top surface.

17. The tape cassette according to claim 16, wherein a part of the top connection wall defines a part of the edge defining the second hole.

18. The tape cassette according to claim 1, wherein the third and first corner portions are disposed diagonally at opposite ends of the bottom wall, and the first tape spool, the ribbon spool and the ribbon winding spool are on a diagonal connecting the third corner portion and the first corner portion.

19. The tape cassette according to claim 1, wherein the generally rectangular housing has a head insertion portion configured such that a head of a printer is inserted thereinto, the head insertion portion being positioned in the second area.

20. The tape cassette according to claim 1, wherein the edge of the second hole is defined by a wall at least in part.

21. The tape cassette according to claim 1, wherein the edge of the second hole is defined by a cylindrical wall.

22. A tape cassette comprising:

a generally rectangular housing having a top wall and a bottom wall, the generally rectangular housing defining first, second, third, and fourth corner portions, wherein the fourth and second corner portions are disposed diagonally at opposite ends of the bottom wall;

a first hole formed in the fourth corner portion, the first hole extending from the bottom wall toward the top wall;

a roller provided in the fourth corner portion;

a second hole formed in the second corner portion, the second hole extending from the bottom wall toward the top wall;

a printing tape wound around a printing tape spool, the printing tape spool being positioned in a first area, the first area being at one side with respect to a first straight line connecting the first hole and the second hole;

an ink ribbon wound around a ribbon spool the ribbon spool being positioned in a second area, the second area being at the other side with respect to the first straight line;

a ribbon winding spool configured to wind the ink ribbon, the ribbon winding spool being positioned in the second area; and an arc-like wall extending from the bottom wall toward the top wall, a part of the arc-like wall being a part of an edge defining the second hole, the arc-like wall being convexed toward the second corner portion with a center of an arc along which the arc-like wall is formed being positioned inside the arc-like wall and the second hole being outside the arc-like wall.

23. The tape cassette according to claim 22, further comprising a third hole formed in the fourth corner portion, wherein a part of the printing tape are positioned at one side with respect to the roller, the third hole is positioned at the opposite side of the one side with respect to the roller, the second hole is an elongated hole having a length greater than a width, the length extending along a second straight line connecting the second hole and the third hole.

24. The tape cassette according to claim 23, wherein the edge defining the elongated hole includes a first edge, a second edge and a third edge, the first edge and the second edge extending along the second straight line, the width of the elongated hole being a width between the first edge and the second edge, the third edge connecting one end of the first edge with one end of the second edge.

25. The tape cassette according to claim 24, wherein the third edge is the part of the arc-like wall.

26. The tape cassette according to claim 25, wherein the third edge convexly protrudes toward the third hole.

27. The tape cassette according to claim 24, wherein the elongated hole is a closed hole defined by the first edge, the second edge, the third edge and a fourth edge, the fourth edge being opposite to the third edge and connecting the other end of the first edge with the other end of the second edge, the fourth edge convexly protruding away from the third hole.

28. The tape cassette according to claim 23, wherein the third hole is formed as a first indentation, the first indentation being provided at one side with respect to the roller in a first direction perpendicular to the part of the printing tape, the part of the printing tape being positioned at the other side with respect to the roller in the first direction, the first indentation having a first bottom opening, a first extending wall and a first top ceiling, the first bottom opening being formed in the fourth corner portion and in the bottom wall, the first top ceiling being provided between the bottom wall and the top wall in a second direction perpendicular to the bottom wall, the first top ceiling being generally parallel to the bottom wall, the first extending wall extending from the first bottom opening to the first top ceiling.

29. The tape cassette according to claim 28, further comprising a fourth hole, the fourth hole extending from the bottom wall toward the top wall, the fourth hole being positioned at the same side with the first hole with respect to the second hole in the first direction.

30. The tape cassette according to claim 29, wherein the fourth hole is formed as a second indentation, the second indentation having a second bottom opening, a second extending wall and a second top ceiling, the second bottom opening being formed in the bottom wall, the second top ceiling being provided between the bottom wall and the top wall in the second direction, the second top ceiling being generally parallel to the bottom wall, the second extending wall extending from the second bottom opening to the second top ceiling.

31. The tape cassette according to claim 23, wherein the third hole is configured to accommodate a positioning pin of a printer.

32. The tape cassette according to claim 22, wherein the second hole is a through-hole extending from the bottom wall to the top wall.

33. The tape cassette according to claim 22, wherein the first hole is configured to accommodate a guide shaft of a printer, and the second hole is configured to accommodate another guide shaft of the printer.

34. The tape cassette according to claim 22, wherein the ribbon winding spool is configured to accommodate a ribbon take-up shaft of a printer.

35. The tape cassette according to claim 22, wherein the bottom wall comprises a first bottom surface, a second bottom surface and a bottom connection wall, the second bottom surface being closer to the top wall than the first bottom surface, the bottom connection wall connecting the first bottom surface and the second bottom surface, the second hole having an opening in the second bottom surface.

36. The tape cassette according to claim 35, wherein a part of the bottom connection wall defines a part of the edge defining the second hole.

37. The tape cassette according to claim 22, wherein the top wall comprises a first top surface, a second top surface and a top connection wall, the second top surface being closer to the bottom wall than the first top surface, the top connection wall connecting the first top surface and the second top surface, the second hole having an opening in the second top surface.

38. The tape cassette according to claim 37, wherein a part of the top connection wall defines a part of the edge defining the second hole.

39. The tape cassette according to claim 22, wherein the third and first corner portions are disposed diagonally at opposite ends of the bottom wall, and the printing tape spool, the ribbon spool and the ribbon winding spool are on a diagonal connecting the third corner portion and the first corner portion.

40. The tape cassette according to claim 22, wherein the generally rectangular housing has a head insertion portion configured such that a head of a printer is inserted thereinto, the head insertion portion being positioned in the second area.

41. The tape cassette according to claim 22, wherein the edge of the second hole is defined by a wall at least in part.

42. The tape cassette according to claim 22, wherein the edge of the second hole is defined by a cylindrical wall.

* * * * *